US011465722B2

(12) United States Patent
Bethwaite

(10) Patent No.: US 11,465,722 B2
(45) Date of Patent: Oct. 11, 2022

(54) RIGGING SYSTEM

(71) Applicant: Up Marine Technology Limited, Wanchai (HK)

(72) Inventor: Julian Bethwaite, Wanchai (HK)

(73) Assignee: Up Marine Technology Limited, Wanchai (HK)

( * ) Notice: Subject to any disclaimer, the term of this patent is extended or adjusted under 35 U.S.C. 154(b) by 682 days.

(21) Appl. No.: 16/304,083

(22) PCT Filed: May 25, 2017

(86) PCT No.: PCT/AU2017/050490
§ 371 (c)(1),
(2) Date: Nov. 21, 2018

(87) PCT Pub. No.: WO2017/201580
PCT Pub. Date: Nov. 30, 2017

(65) Prior Publication Data

US 2021/0269133 A1 Sep. 2, 2021

(30) Foreign Application Priority Data

May 25, 2016 (AU) ..... 2016901979

(51) Int. Cl.
*B63H 9/10* (2006.01)
*B63B 15/00* (2006.01)
*B63H 9/08* (2006.01)

(52) U.S. Cl.
CPC ..... *B63H 9/1085* (2013.01); *B63B 15/0083* (2013.01); *B63B 2015/0016* (2013.01); *B63H 2009/084* (2013.01)

(58) Field of Classification Search
CPC ..... B63B 15/0083; B63B 2015/0016; B63H 2009/084; B63H 9/1085; B63H 9/10; B63H 9/08
See application file for complete search history.

(56) References Cited

U.S. PATENT DOCUMENTS 5,070,802 A * 12/1991 Corlett ..... B63H 9/1085 114/99
6,062,155 A 5/2000 Corlett
2012/0266798 A1* 10/2012 Winnington-Ingram ..... B63H 9/10 114/98

FOREIGN PATENT DOCUMENTS

AU 2012202230 B2 11/2012
CN 102325695 A 1/2012
(Continued)

OTHER PUBLICATIONS

Boomkicker Boom Supports [retrieved Dec. 22, 2016]<URL: http://web.archive.org/web/20160109145356/http://boomkicker.com/> published on Jan. 9, 2016 as per Wayback Machine, Images labelled 'Mizzen on Amel 46' Ketch' and 'Esse 750'.
(Continued)

*Primary Examiner* — Andrew Polay
(74) *Attorney, Agent, or Firm* — Knobbe, Martens, Olson & Bear, LLP

(57) ABSTRACT

A rigging system (1) for a sailboat comprising: a mast (3) that extends substantially vertical from a hull; a boom (5) that extends substantially horizontal from the mast (3); a vang tube (7) extending between the mast and the boom to resist relative force and/or moment of the boom (5) towards the mast (3), wherein the vang tube (7) is substantially arcuate and a convex side of the actuate vang tube (7) faces an intersection (9) of the boom (5) and the mast (3) and wherein the vang tube (7) is located above the boom (5). A connection (301) for transferring a first force from a spar (307) to a mast (3) of a sailboat, the connection comprising: a connection base (303) having a key portion (305) to be received in a keyway (306), wherein the keyway (306) is part of a sail track (107) of the mast (3); a mount (309) to receive the spar (307), wherein the first force (35) from the
(Continued)

spar (307) is transmitted through the mount (309) to the connection base (303); and a restraint (311) to resist a first component force (37) acting on the connection base (303), wherein the first component force (37) is a component of the first force (35) transmitted from the spar (307) that is in a direction parallel to the keyway (306).

13 Claims, 37 Drawing Sheets

(56) References Cited

FOREIGN PATENT DOCUMENTS

| | | | | |
|---|---|---|---|---|
| CN | 103523195 | A | 1/2014 | |
| EP | 2514665 | A2 | 10/2012 | |
| FR | 2900633 | A1 | 11/2007 | |
| WO | WO-2008036418 | A2 * | 3/2008 | ..... B63H 9/1028 |

OTHER PUBLICATIONS

VX One Design—Sail Magazine [retrieved May 1, 2017] <URL: http://web.archive.org/web/20150907183852/http://www.sailmagazine.com/boat-reviews/vx-one-design/> published Sep. 7, 2015 as per Wayback Machine, First Image on webpage.

International Search report for Application No. PCT/AU2017/050490, dated Aug. 3, 2017 in 7 pages.

Written Opinion for Application No. PCT/AU2017/050490, dated Aug. 3, 2017 in 6 pages.

Brazilian Office Action issued in the corresponding Brazilian application, BR112018074165-5, dated Nov. 4, 2021 in 4 pages.

Observations: Priorities were pointed out by family documents AU20170268711, which can be found at; http://ccd.fiveipoffices.org/CCD-2.2.0/html/viewCcd.htmlnum=AU20170268711&format=epodoc&type=application.

* cited by examiner

ENLARGED VIEW AREA - A

ENLARGED VIEW AREA - A

FRONT VIEW

REAR VIEW

RIGGING SYSTEM

CROSS-REFERENCE TO RELATED APPLICATIONS

This application is the U.S. National Phase under 35. U.S.C. § 371 of International Application PCT/AU2017/050490, filed May 25, 2017, which claims priority to Australian Patent Application No. 2016901979, filed May 25, 2016. The disclosures of the above-described applications are hereby incorporated by reference in their entirety.

TECHNICAL FIELD

The present disclosure relates to a rigging system for a sailboat.

BACKGROUND

The rigging system is a vital component for propelling a sailboat. Sailboats are commonly used for sporting purposes and small increases in performance can be important in providing the competitive advantage to win a race.

In some sailboats, a boom vang is used to provide a downward force on a boom to assist in maintaining the shape of a sail. The boom vang may include a rigid straight vang tube (such as in a "49er" sailboat), a piston system, a pulley system, or combinations thereof. Such components may add weight and bulk to the sailboat.

Competitive sailing may be competitive and high stress and ease of use of sailing components may give the sailor a competitive advantage. Safety is another important factor and it may be desirable that at least part of the rigging is readily collapsible in the event of strong winds. Furthermore it would be desirable to have components arranged to lower the risk of moving components injuring the sailor(s).

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

A rigging system for a sailboat comprising: a mast that extends substantially vertical from a hull; a boom that extends substantially horizontal from the mast; a vang tube extending between the mast and the boom to resist relative force and/or moment of the boom towards the mast, wherein the vang tube is substantially arcuate and a convex side of the actuate vang tube faces an intersection of the boom and the mast and wherein the vang tube is located above the boom.

In the rigging system, the arcuate vang tube may be arcuate with substantially constant radius.

The rigging system may further comprise a sail, wherein in use at least a part of the sail is supported by the vang tube such that the vang tube assists a transition from a straight foot of the sail adjacent the boom to a fair curve of the sail.

In the rigging system, the sail may comprise a luff and proximal to a tack of the sail, the luff comprises: a first sheet portion at a windward side of the sail; and a second sheet portion at a leeward side of the sail, wherein in use, the arcuate vang tube passes between the first sheet portion and the second sheet portion such that at least part of the luff is supported by the vang tube.

The rigging system may allow the sail to have a greater depth and/or increase the area of the sail with depth. This may increase the efficiency of the sail.

A mast head for a mast comprising: a main body to mount to a hollow of the mast; a pair of feed lips to guide a bolt rope of a sail to a sail track; and wherein the main body includes an exhaust passage to allow fluid communication from the hollow of the mast to a surrounding atmosphere.

The mast head may allow ventilation of the mast to reduce the temperature and the The mast head may further comprise a mast head hook to receive a retention loop of the sail.

The mast head may further comprise: a spigot extending from the main body wherein in use at least part of the spigot is received in the hollow of the mast.

In the mast head, the exhaust passage may include an exhaust port, wherein in use the exhaust port is directed to the surrounding atmosphere, at least in part, between a vertically upward direction and an aft direction.

In the mast head, the exhaust passage may include an inlet port wherein the inlet port allows fluid flow from the hollow of the mast into the exhaust passage, wherein the inlet port and the exhaust port have different sizes.

In the mast head, a cross-sectional area of the inlet port may be greater than a cross-sectional area of the exhaust port.

A releasable swivel to selectively couple a first spar and a second spar of a sailboat, wherein the swivel allows the first spar to rotate relative to the second spar around a swivel axis, the swivel comprising: a first support to be fixed to the first spar wherein the first support includes at least one swivel pin, wherein in use the swivel pin is configured to extend along the swivel axis; a second support comprising: a base body to be fixed to the second spar; a pair of flanges extending from the base body, wherein each flange comprises an open slot to receive the at least one swivel pin of the first support; and a releasable catch to retain the at least one swivel pin within the open slots of the flanges such that the first support is coupled to the second support, and wherein at least one swivel pin is rotatable within the open slot to allow rotation of the first support relative to the second support.

In the releasable swivel, the at least one swivel pin is received to an in use position at the open slot from a first direction that is substantially perpendicular to the swivel axis, and wherein the releasable catch further comprises a locking surface, wherein the locking surface prevents movement of the at least one swivel pin in a second direction that is opposite the first direction.

In the releasable swivel, the releasable catch may further comprise a trigger to allow a user to selectively release the catch, wherein on selective release of the catch the at least one swivel pin is movable from the open slots in the second direction, and wherein the trigger is located outside a pathway of the at least one swivel pin in the second direction.

In the releasable swivel, the releasable catch may further comprise a cam surface, wherein to couple the first support to the second support includes inserting the at least one swivel pin into the open slot in the first direction, wherein the first support interacts with the cam surface to release the catch such that the such that the swivel pin is receivable to the in use position at the open slot.

In the releasable swivel the releasable catch may further comprise: a pawl having the locking surface in the form of a locking recess to receive at least part of the swivel pin, wherein the pawl is biased such that at least part of the swivel pin is received in the locking recess.

In the releasable swivel, the releasable catch may comprise a resilient material to bias the pawl.

In the releasable swivel, the first spar and second spar may be any one of a mast, boom, or vang tube. The releasable swivel may allow quick coupling and release of spars of the sailboat.

A connection for transferring a first force from a spar to a mast of a sailboat, the connection comprising: a connection base having a key portion to be received in a keyway, wherein the keyway is part of a sail track of the mast; a mount to receive the spar, wherein the first force from the spar is transmitted through the mount to the connection base; a restraint to resist a first component force acting on the connection base, wherein the first component force is a component of the first force transmitted from the spar that is in a direction parallel to the keyway.

In the connection, the restraint may include an aperture to receive cordage tensioned to limit movement of the connection base in the keyway, wherein a length of the cordage is selectively adjustable to adjust a location of the connection base along the keyway.

In the connection, the connection base may further comprise a socket and the mount further comprises a bearing, wherein in use, the bearing of the mount is inserted into the socket such that: the first force is transmitted from the bearing of the mount to the socket of the connection base; and the mount is rotatable relative to the connection base around a connection axis that is perpendicular to the keyway, and wherein the mount and the connection base are separate components such that when not in use, the connection base and mount are separable.

In the connection, the connection base may comprise an insert portion and the mount comprises a recess, wherein the insert portion is received in the recess to resist relative movement of the mount and connection base along the connection axis.

The connection may allow a user to easily disassemble spars forming the rigging when not in use.

In some examples, the connection base and the mount are joined with a ball and socket joint, wherein in use: the first force is transmitted from the mount, through the ball and socket joint, to the connection base; and wherein the mount is rotatable relative to the connection base.

In some examples, the ball is associated with the mount and the socket is associated with the connection base, wherein the connection base further comprises a ball track to allow selective insertion and removal of the ball from the socket; wherein in use, the ball is received in the socket to transmit the first force; and wherein the ball is selectively removable from the socket such that when not in use, the mount and connection base are separable.

A rigging system as described above further comprising the mast head described above.

A rigging system further comprising the releasable swivel described above.

A rigging system further comprising the connection described above.

BRIEF DESCRIPTION OF DRAWINGS

Examples of the present disclosure will be described with reference to.

DESCRIPTION OF EMBODIMENTS

Overview

Figure 1:
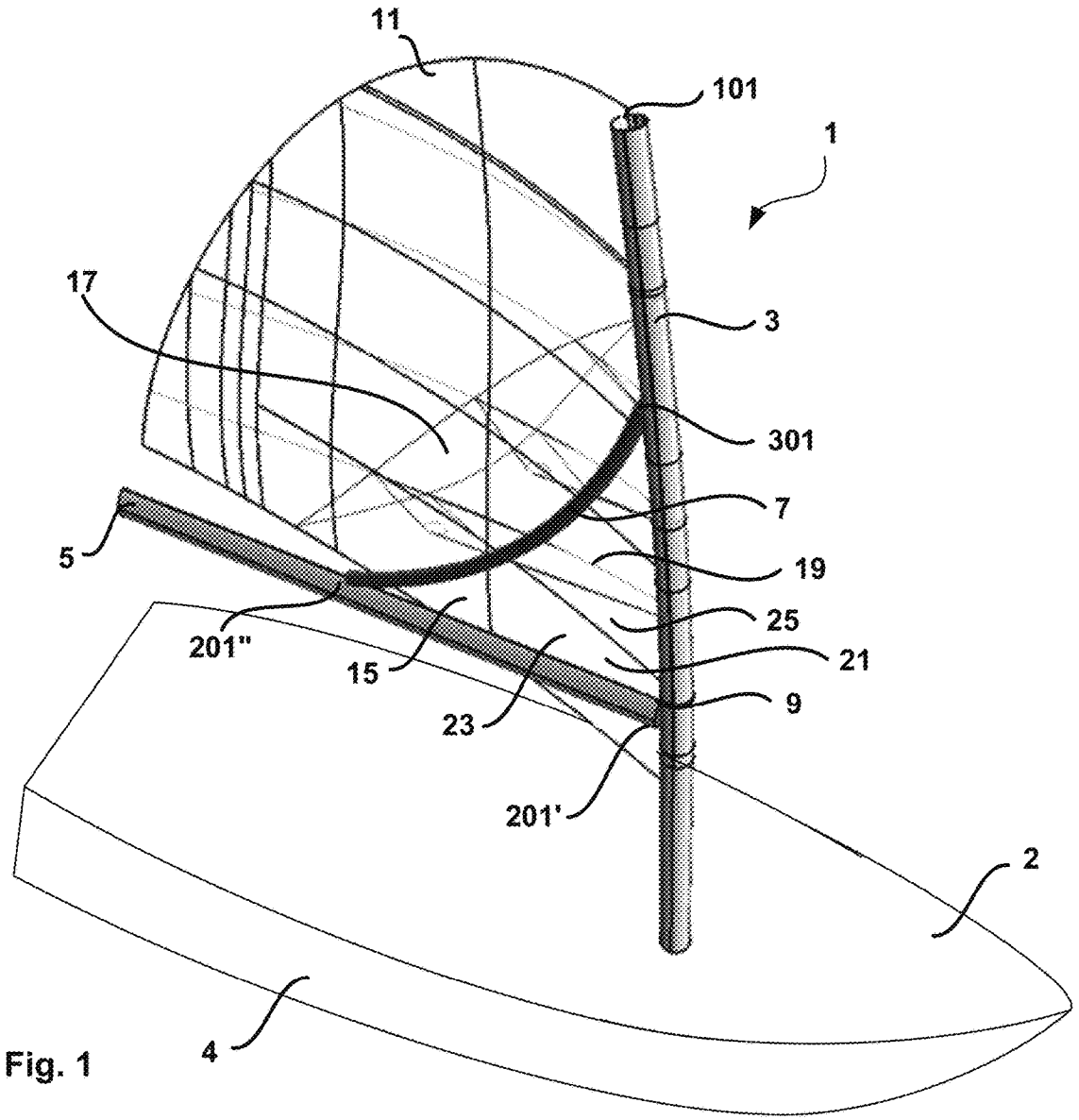
FIG. 1 is a perspective view of a rigging system on a sailboat.

FIG. 1 illustrates a rigging system 1 for a sailboat 2. The rigging system 1 includes a mast 3 that extends substantially vertical from a hull 4 of the sailboat 2. A boom 5 extends horizontal to the mast 3, and in use a sail 11 is rigged to the mast 3 and the boom 5.

A vang tube 7 extends between the mast 3 and the boom 5 to resist relative force and/or moment of the boom 5 towards the mast 3. That it, the vang tube 7 provides a downward force to the boom 5 which assists in maintaining the shape of the sail 11. The vang tube 7 is substantially arcuate with the convex side facing an intersection 9 of the boom 5 and the mast 3.

In use, at least part of the sail 11 is supported by the vang tube 7 such that the vang tube 7 assists a transition from a straight foot 15 of the sail adjacent the boom 5 to a fair curve of the sail 11. Furthermore the curved vang tube 7 may also provide greater depth and/or depth for a larger area of the sail 11 compared to a vang tube that is substantially straight.

A mast head 101 is provided at the top of the mast 3, where the mast head 101 facilitates insertion and retention of the sail 11 as well as ventilation of the mast 3.

Releasable swivels 201 are provided to couple spars to one another whilst allowing relative rotation (at least to a range of degrees) to one another. A first releasable swivel 201' couples the mast 3 and the boom 5, and a second releasable swivel 201" couples the boom 5 and the vang tube 7.

A connection 301 is provided to allow the transfer of force from a spar to the mast 3. In one example, this includes transferring force from the vang tube 7 to the mast 3.

The parts of the rigging system 1 will now be described in detail.

The Rigging System 1 with Curved Vang Tube 7

Figure 5:
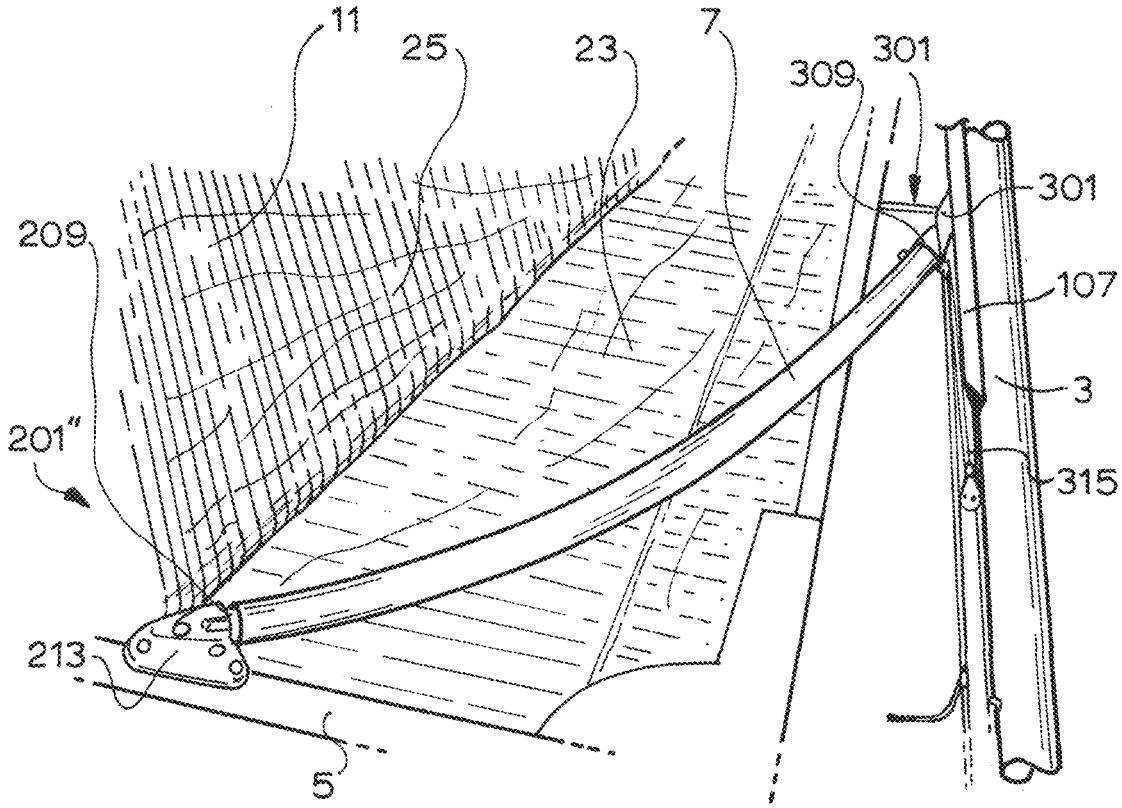
FIG. 5 is a side view of a vang tube connected to a mast and a boom in the rigging system.

Referring to FIG. 5, the curved vang tube 7 is in the form of an arcuate spar that this connected to the mast 3 and the boom 5. In the illustrated example, the curved vang tube 7 is located above the boom 5 and aft of the mast 3, whereby the convex side of the curved vang tube 7 faces the intersection 9 of the boom 5 and the mast 3.

In some examples, the curved vang tube 7 has a substantially constant radius. The tube 7 may be made of extruded aluminium, such as aluminium pipe, that is bent to achieve the required curve. The tube 7 may be constructed by other means, for examples, fibre reinforced plastics (which may include one or more of fibreglass, aramid fibre, carbon fibre) that is moulded to shape.

The ends of the vang tube 7 may be attached to the mast 3 and boom 5 by connection 301 and releasable swivel 201" respectively. The connection 301 and releasable swivel 201" may allow the user to selectively adjust, to degree, the configuration of the rigging system 1. The connection 301 and swivel 201" may also allow the user to easily disconnect the vang tube 7 from the mast 3 and boom 5 for storage and/or in an emergency.

Figure 6:
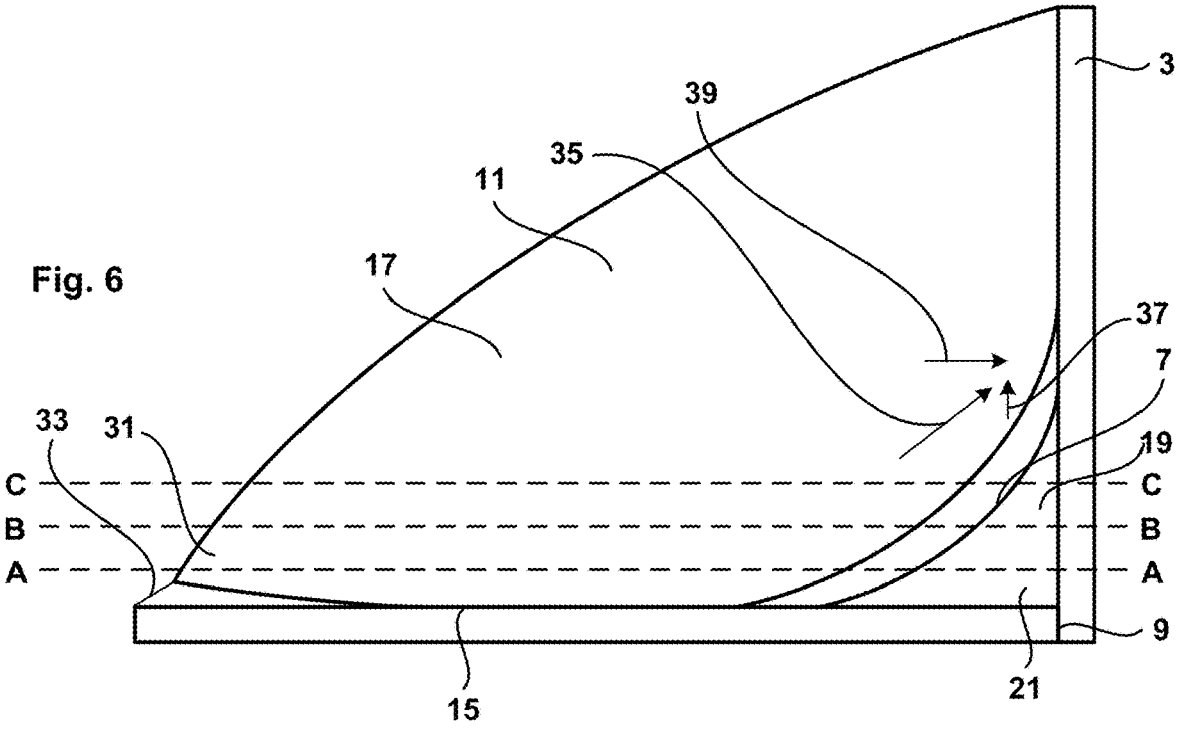
FIG. 6 is another side view of the rigging system.

The operation of the vang tube 7 will now be described with reference to FIG. 6. The vang tube 7 operates as a strut to resist compression caused by the boom 5 lifting above the horizontal. The boom 5 may be upwardly forced as the sail 11 catches wind such that the clew 31 of the sail 11, via the outhaul 33, pulls against the boom 5. This causes the boom 5 to lift, and to exert a moment on the boom 5 around the intersection 9.

To resist this lift, the vang tub 7 is provided between the mast 3 and the boom 5. Thus the upwardly forced boom 5 transmits a force to the vang tube 7, which in turn transmits a resultant first force 35 towards the mast 3. This first force 35 has two components: a first component force 37 that is in a vertical direction parallel to the mast 3 (and sail track 107); and a second component force 39 that is in a horizontal direction towards (i.e. perpendicular to) the mast 3. The vertical first component force 37 is resisted by a restraint 311 of the connection 301 (discussed in further detail below) which tensions cordage 315 to absorb this force. The horizontal second component force 39 is resisted by the mast 3.

Increasing the Depth with a Curved Vang Tube 7

The effect of the curved vang tube is to increase the depth of the sail and/or the area of the sail 11 with depth. The result is to increase the efficiency of the sail 11 which will now be described with reference to FIGS. 6 to 8.

Figure 7A:
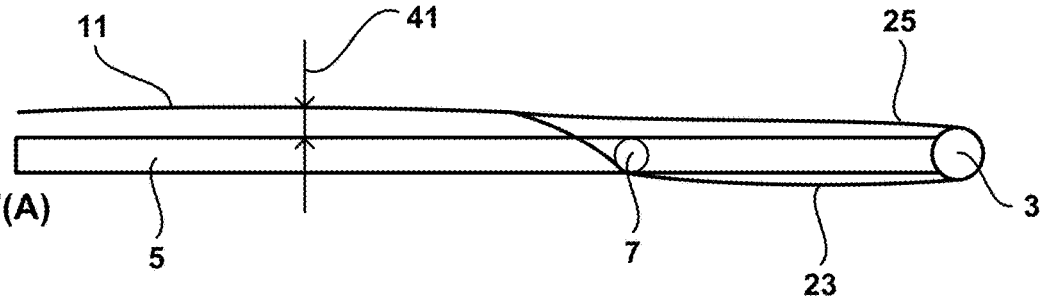
FIGS. 7(A) to 7(C) are cross-sectional views of the rigging system along A-A, B-B and C-C in FIG. 6.
Figure 7B:
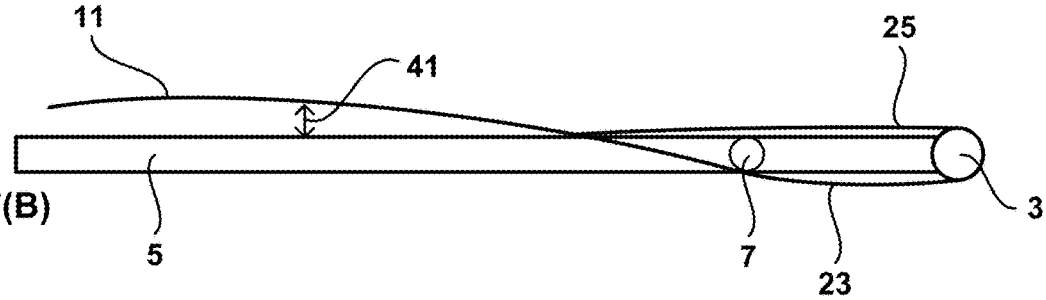

The sail 11 may have a luff 19 wherein at an area proximal to the tack 21 of the sail, the luff 19 includes: a first sheet portion 23 at a windward side of the sail 11; and a second sheet portion 25 at a leeward side of the sail 11. The arcuate vang tube 7 passes between the first sheet portion 23 and the second sheet portion 25 as shown in FIGS. 7*a* to 7*b* (which show a sectioned views along lines A-A, B-B, and C-C of FIG. 6).

Figure 7C:
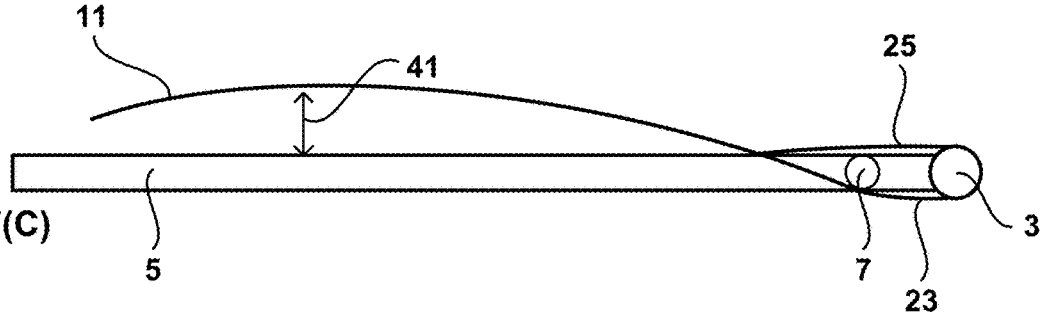

Therefore during use, the first sheet portion 23 on the windward side (also known as the pressure side) of the sail 11 will be pushed towards the second sheet portion 25, and that at least a part of the sail 11 will be pushed towards, and supported by, the vang tube 7 as shown in FIG. 7. In this example, the depth 41 of the fair curve 17 of the sail is formed (at least in the lower parts of the sail 11) aft of the vang tube 7. This is because the supporting vang tube 7 may prevent, or reduce, the depth that can be formed at these lower portions of the sail 11 (in particular around the first sheet portion 23).

Figure 8:
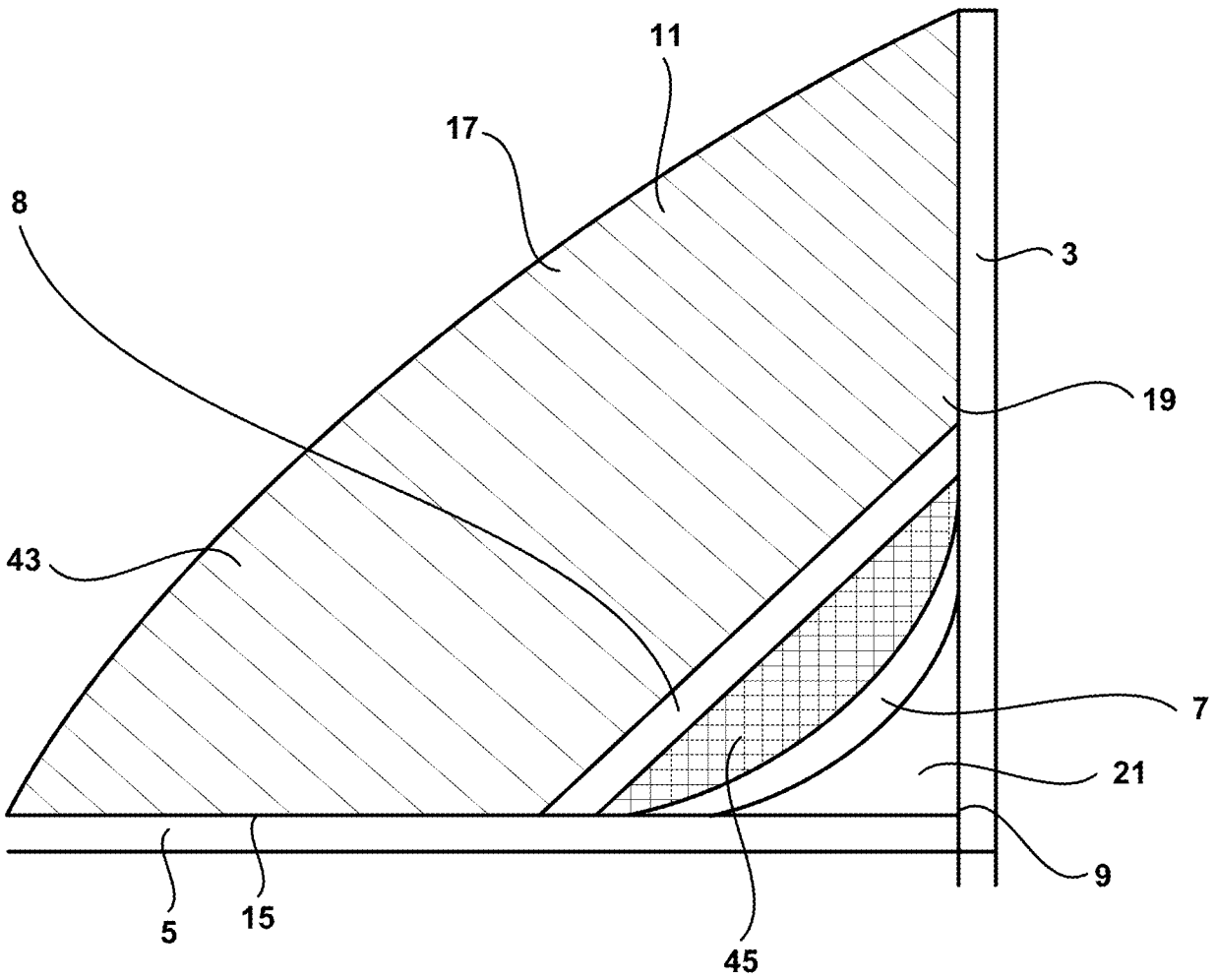
FIG. 8 is another side view of the rigging system comparing a straight vang tube with a curved vang tube.

The advantage of a curved vang tube 7 compared with a straight vang tube 8 is illustrated in FIG. 8. The straight vang tube 8 may provide an area 43 of the sail 11 to have depth 41, whereby the portions of the sail fore of the vang tube 8 (such as the first sheet portion 23) does not form depth but is instead substantially flat and parallel with the boom 5 and/or mast 3. In contrast, the curved vang tube 7 may, in addition to area 43, provide an additional area 45 of the sail 11 that can also have depth 41. Having a greater area of the sail 11 with depth can increase the efficiency of the sail 11 since the fair curvature of the sail 11 is maintained for longer and the amount of disruption is reduced. The curve vang tube 7 also assists the transition from the straight foot 15 of the sail to the fair curve of the sail 17 whereby the transition occurs smoothly, cleanly, and over a shorter distance compared to a straight vang tube 8. In some examples, the curved vang tube 7 may also allow a portion of the sail 11 with maximum depth 41 to be greater than that of a sail using a straight vang tube 8). One or more of these above features may assist in the efficiency of the aerofoil created by the sail 11, thereby providing greater performance to the sailboat.

The second sheet portion 25 at the leeward side of the sail 11 may cover parts of the vang tube 7 to assist aerodynamic efficiency of the sail in the area between the mast 3 and the vang tube 7.

The Mast Head 7

Figure 2:
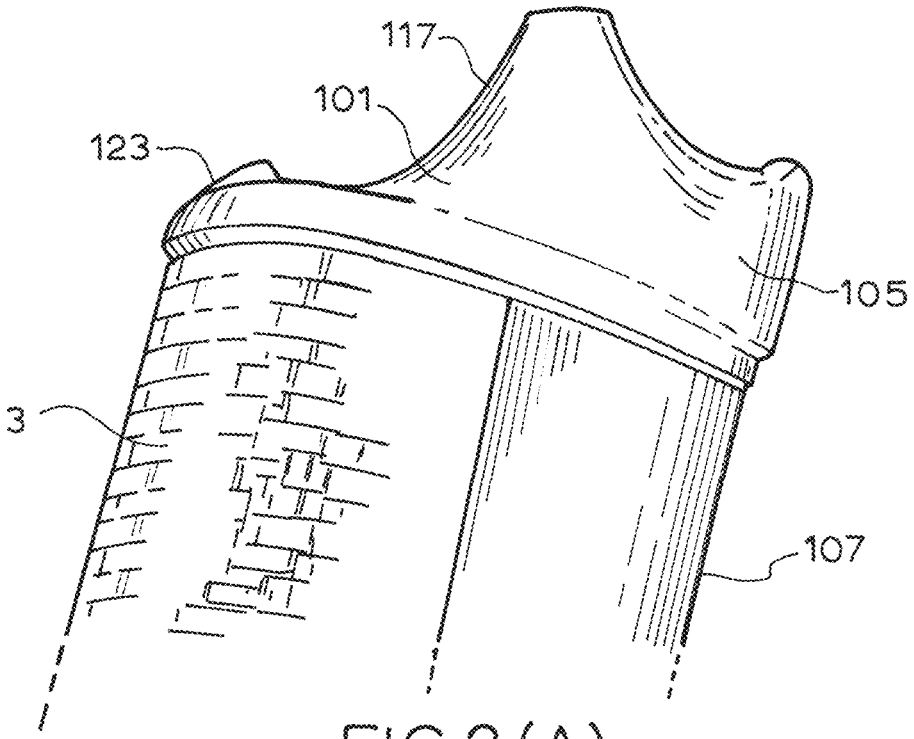
FIGS. 2(A) to 2(J) are view of a mast head of the rigging system.
Figure 2:
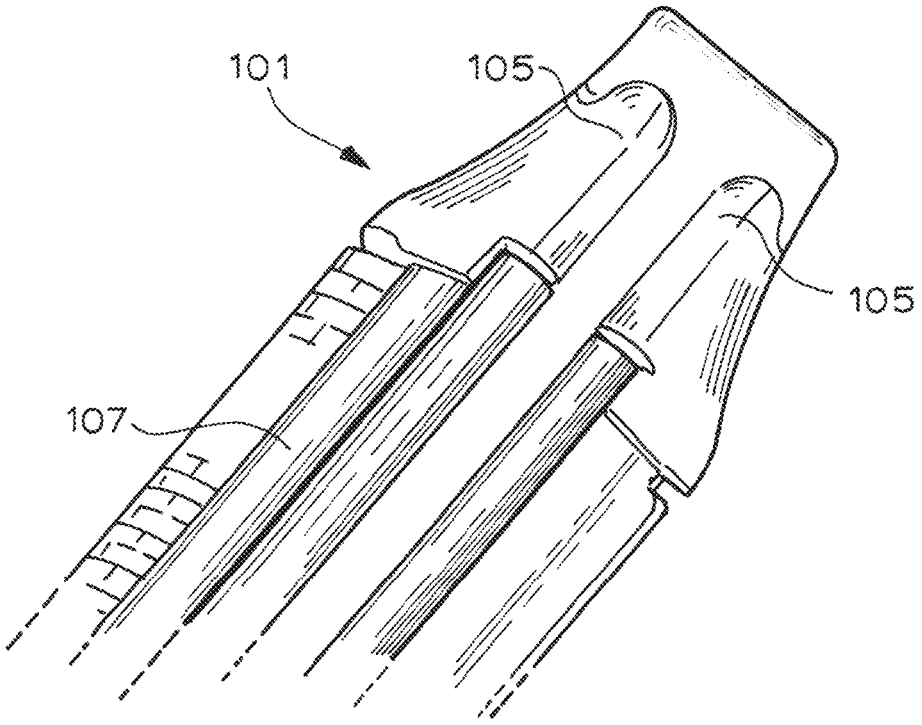
Figure 2C:
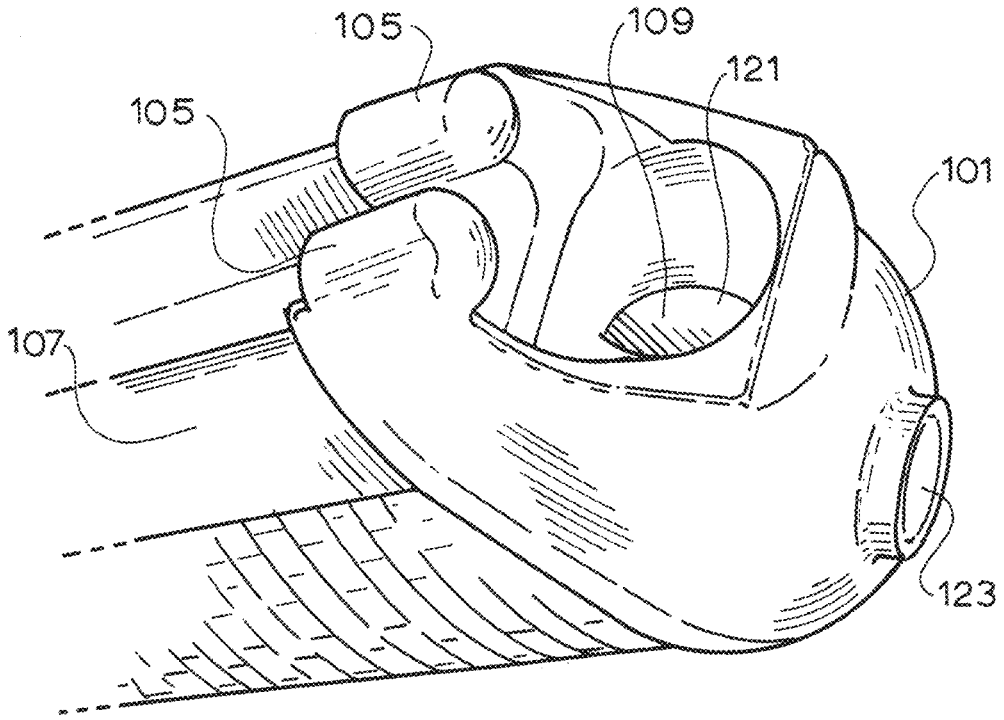
Figure 2D:
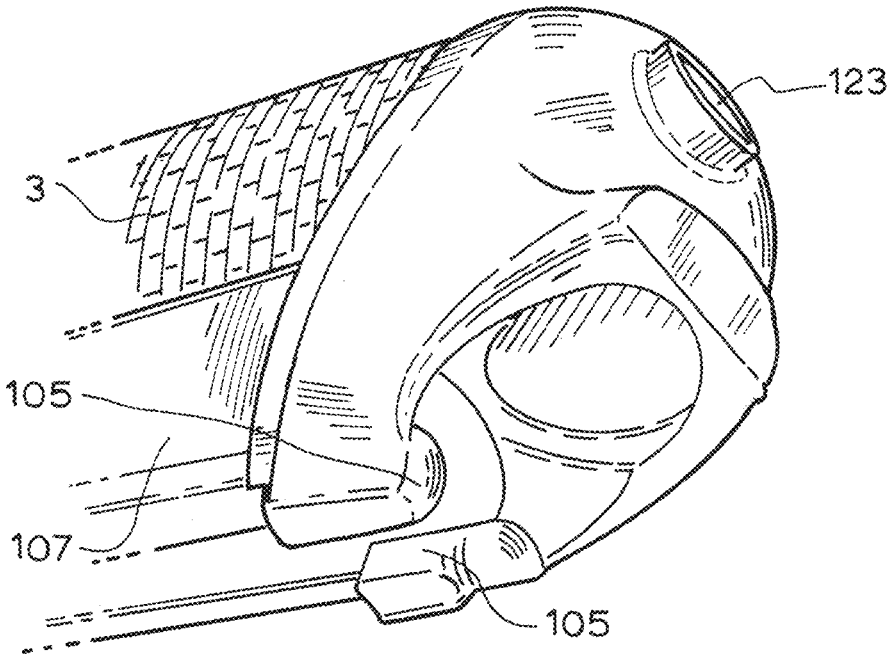

Referring to FIGS. 2(A) to (2(J), a mast head 101 is provided at the top of the mast 3. The mast head 101 comprises a main body 103 that mounts to a hollow of the mast 3. A pair of feed lips 105 is provided to guide a bolt rope 14 of a sail 11 to a sail track 107. The feed lips 105 may allow the bolt rope of the sail 11 to be inserted from the top of the mast 3.

The main body 103 also includes an exhaust passage 109 to allow fluid communication from the hollow of the mast 3 to a surrounding atmosphere. This may allow warm air from within the mast 3 (heated by the sunlight impinging on the mast) to rise up and vent out. This may be assisted by further including a fluid passage towards the lower portion of the mast 3 for air to enter the mast 3. This ventilation of the mast may assist in reducing temperature of the mast 3 which in turn may prolong the life of the mast 3.

The main body 103 of the mast head 101 may be constructed from metals including aluminium, steel, stainless steel, titanium, and alloys thereof. This may include moulding, forging and/or machining In some examples, it is desirable to select a material that would not corrode and/or cause galvanic corrosion with one or more adjacent parts of the rigging system 1. In other examples, the main body 103 of the mast head may be constructed of other materials such as plastics and fibre reinforced plastics.

In the illustrated example, the mast head 7 is an integrally formed component. The mast head 101 includes a spigot 111 extending from the main body 103, wherein the spigot 111 is provided to be received in the hollow of the mast 3. The spigot 111 may be cylindrical in shape to match a corresponding internal curved wall of the mast 3, although it is to be appreciated that other spigot 111 shapes may be used to match the respective mast 3. The spigot 111 may be hollow to form at least part of the exhaust passage 109 and includes an inlet port 113 to allow fluid flow (in particular warm/hot air) from the hollow of the mast 3.

The main body 103 also includes a flange 115 to assist seating of the mast head 101 at the top of the mast 3 and to prevent the mast head 101 from falling through the hollow of the mast 3.

Figure 2E:
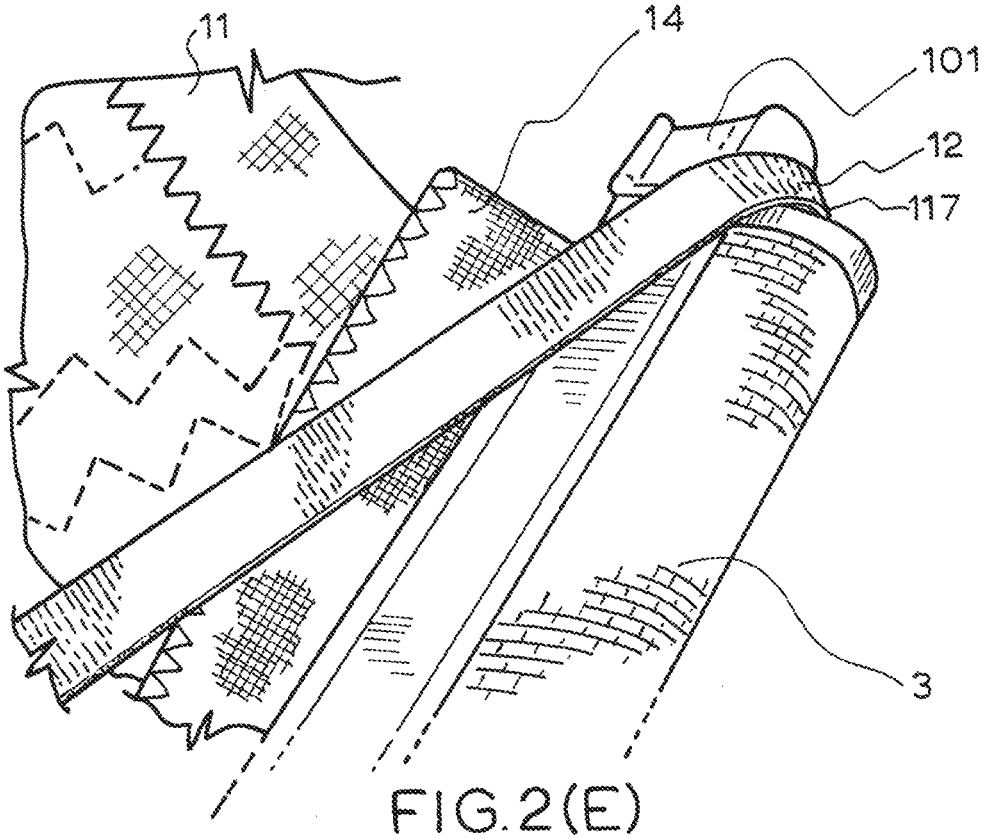
Figure 2F:
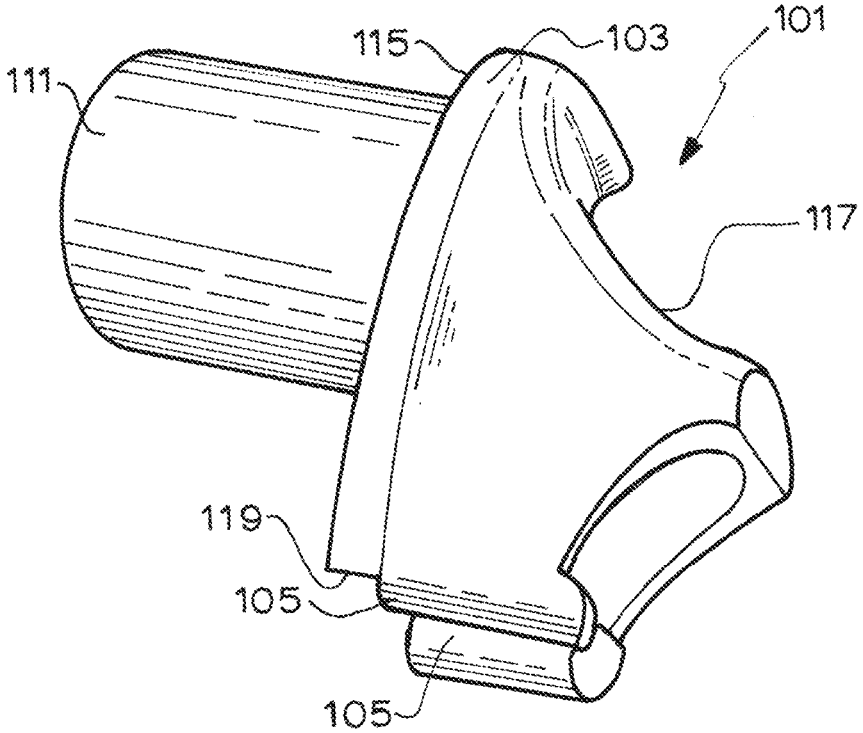
Figure 2G:
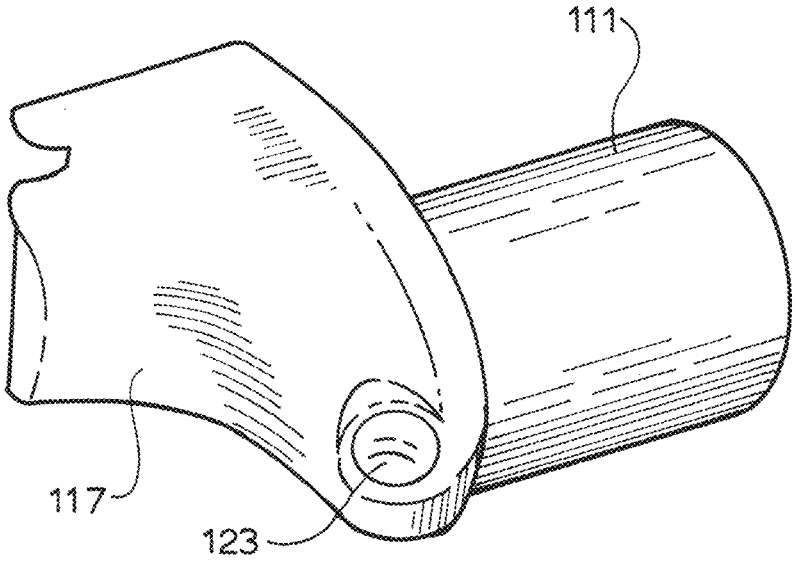
Figure 2H:
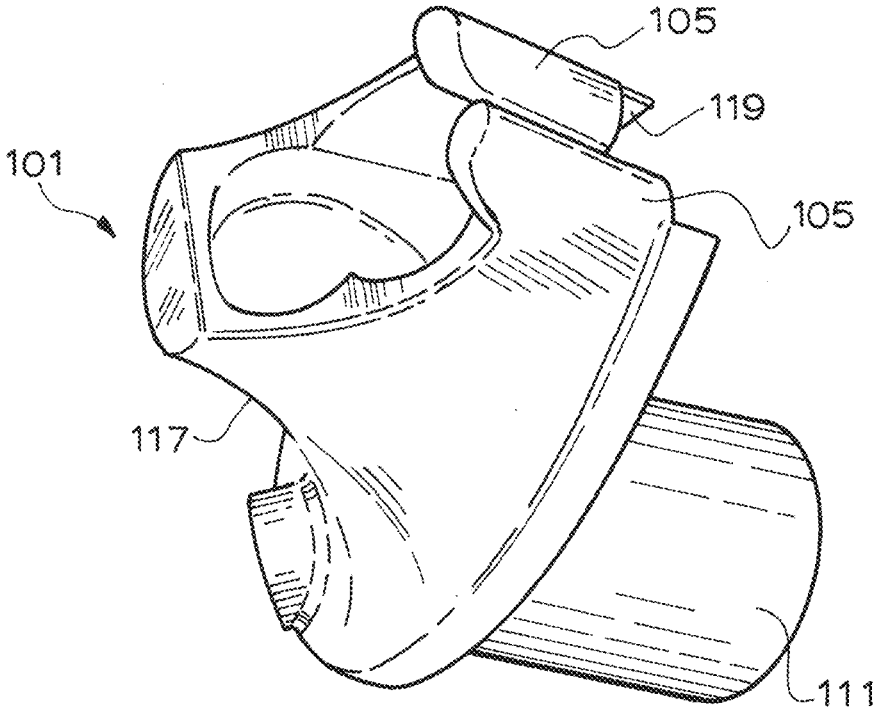

The main body 103 also includes a mast head hook 117 to receive a retention loop 12 of the sail 11 (as shown in FIG. 2(E)). The retention loop 12 is associated with the head (i.e. top) portion of the sail 11 and hooking the retention look 12 to the mast head 101 prevents the sail 11 from falling downwards. The mast head hook 117 in this example is formed by a curved surface of a fore facing side of the main body 103.

The pair of feed lips 105 are located aft of the mast head hook 117. The feed lips 105 assist in insertion of the bolt rope 14 of the sail 11, wherein each feed lip leads to a corresponding lip of the sail track 107. A top edge of the feed lips may be rounded to prevent snagging of the bolt rope 14 and to prevent tears in the sail 11.

Figure 2I:
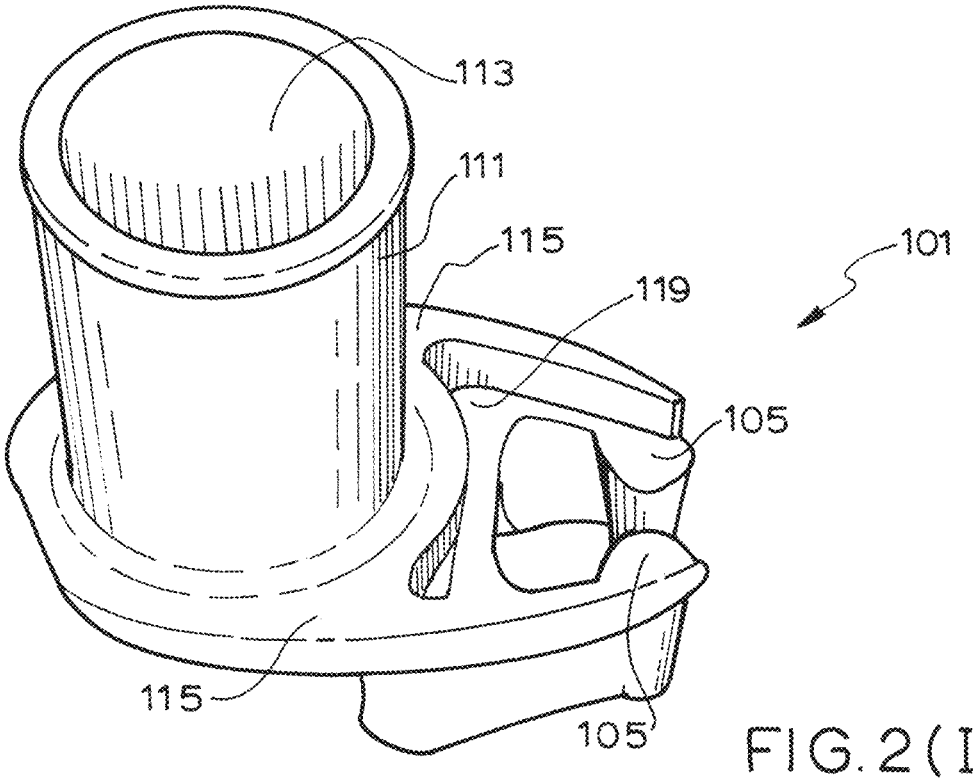

Adjacent the flange 115, a recess 119 (see FIG. 2(I)) is provided to receive a top portion of the sail track 107. The recess 119 may be shaped and/or sized to tightly fit the sail track 107. This may assist alignment and fitting of the mast head 101 to the sail track 107 and mast 3. Having a precise fit may prevent or reduce the likelihood of the bolt rope catching between the transition of the feed lips 105 and the lips of the sail track 107.

Figure 2J:
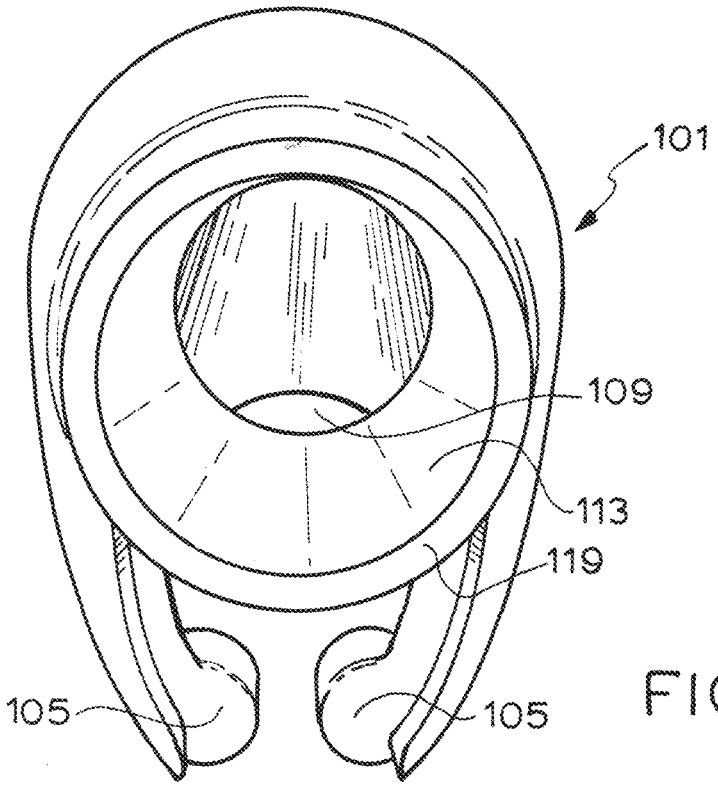

The exhaust passage 109 (see FIG. 2(J)) also includes an exhaust port 121. In some examples, the exhaust port 121 is directed to the atmosphere, at least in part, between a vertically upward direction and an aft direction. Thus in use, a flow of air from fore to aft across the mast head 101 may cause a lower pressure region around the exhaust port 121, which in turn encourages drawing air from the mast 3 and through the exhaust passage 109.

The exhaust port 121 may have a different size compared to the inlet port 113. In some examples, a cross-sectional area of the inlet port is greater than a cross sectional area of the exhaust port 121.

The main body 103 may also include a camera mount 123. This may include providing a threaded aperture, such a 3/8 threaded hole to mount a camera. The threaded aperture in some examples may be provided on a fore facing surface of the mast head 101. In some examples, the threaded aperture passes through to the exhaust passage 109.

The exhaust passage 109 assists ventilation of the mast 3. This may be particularly useful in hot environments and/or environments with extreme sunlight, where the mast 3 (in particular black carbon fibre masts) may reach hot temperatures. Hot temperatures may have an adverse effect on the masts 3 (especially if the temperature exceeds the Temperature Gradient Index for the material), and may cause the mast to soften and bend. This may reduce the performance of the mast 3 as well as the life of the mast 3.

Furthermore, the provision of the feed lips 105 to guide the bolt rope of the sail 11 allows the sail 11 to be fed from the top of the mast 3 and downwards along the sail track 107. The retention loop 12 may then be hooked to the mast head hook 117.

It is to be appreciated that variations of the above features of the mast head 101 may be implemented whilst achieving the function of ventilating the mast 3. For example, in some variations the exhaust passage may be directed vertically upwards. In other variations, the exhaust passage may be directed horizontally aft, horizontally forwards, and/or port and starboard. In yet another example, the mast head 3 may include an aspirator (e.g. injector) to assist in encouraging air to be drawn from the mast 3 and exhausted. This may include using air from the surrounding atmosphere passing across the mast head 101 to create a pressure vacuum to draw air through the inlet port 113.

The Releasable Swivel

Referring to FIGS. 3(A) to 3(F), a releasable swivel 201 is provided to selectively couple a first spar 205 and a second spar 203 of the sailboat 2 to one another. The releasable swivel 201 allows the first spar 205 to rotate relative to the second spar 203 around a swivel axis 207. Examples of spars include the mast 3, the boom 5, and the vang tube 7. In some examples this may include coupling the mast 3 to the boom 5, and/or coupling the vang tube 5 to the boom 7.

The releasable swivel 201 allows two spars to be connected to one another whilst allowing, at least to a degree, relative rotation to one another. A coupling on sailboats that allow such movement is often referred to as a "gooseneck". Such a swivel 201 may be used to couple the mast 3 to the boom 5 and/or the vang tube 7 to the boom 5 as shown in FIG. 1.

Figure 3A:
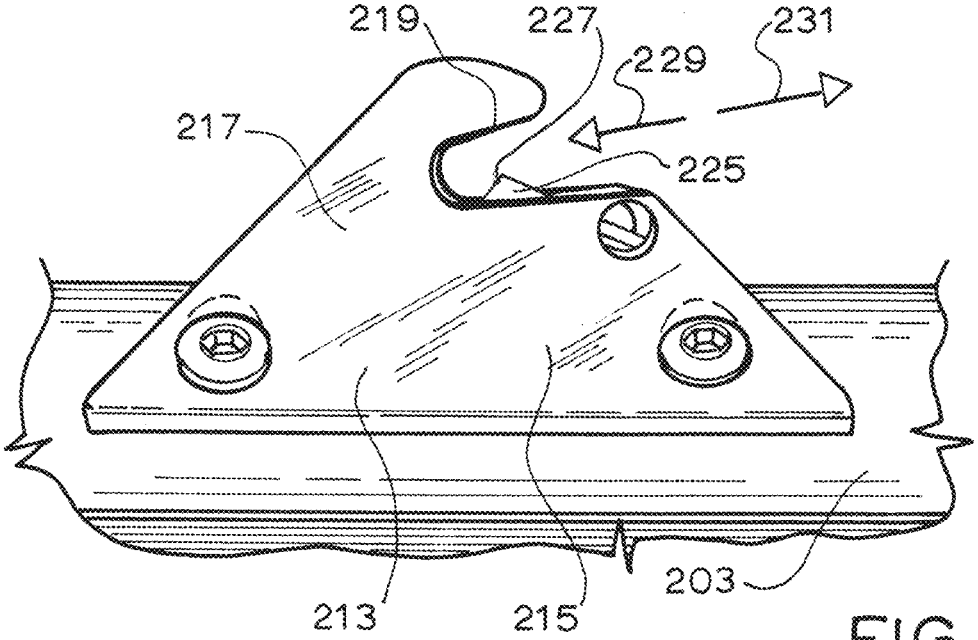
FIGS. 3(A) to 3(F) are views of a releasable swivel of the rigging system.
Figure 3B:
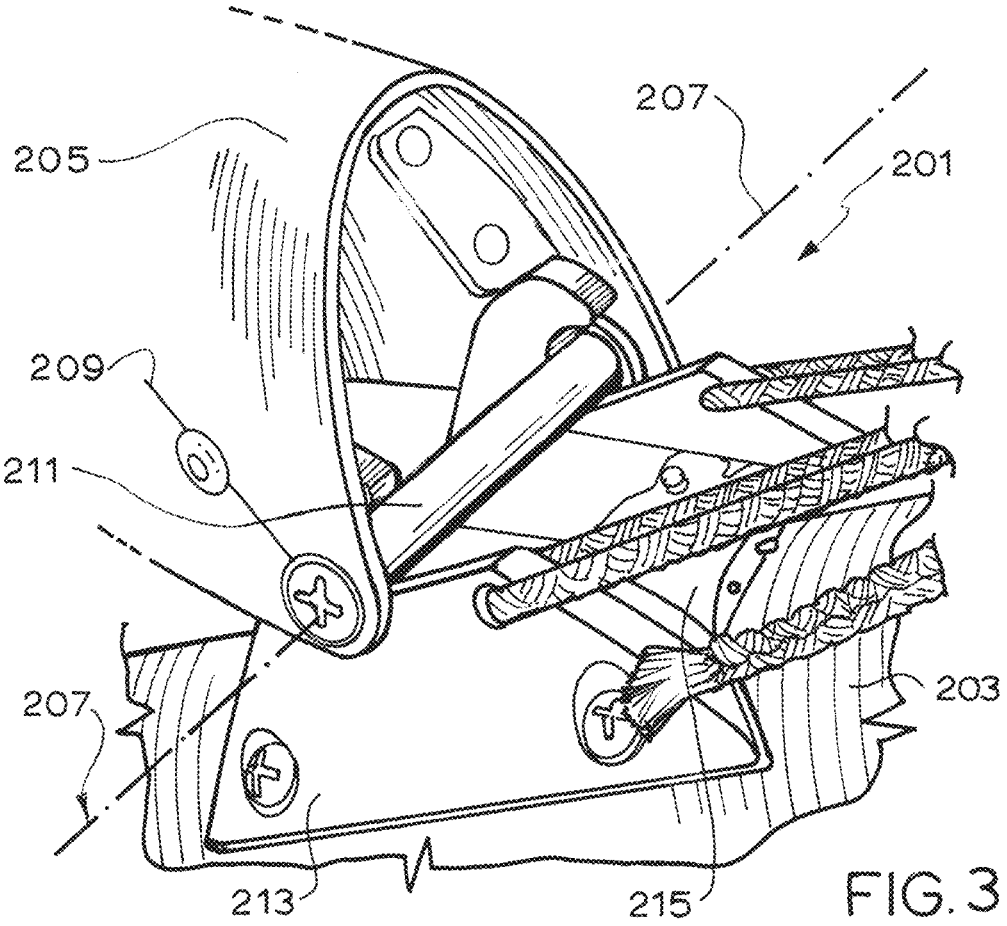
Figure 3C:
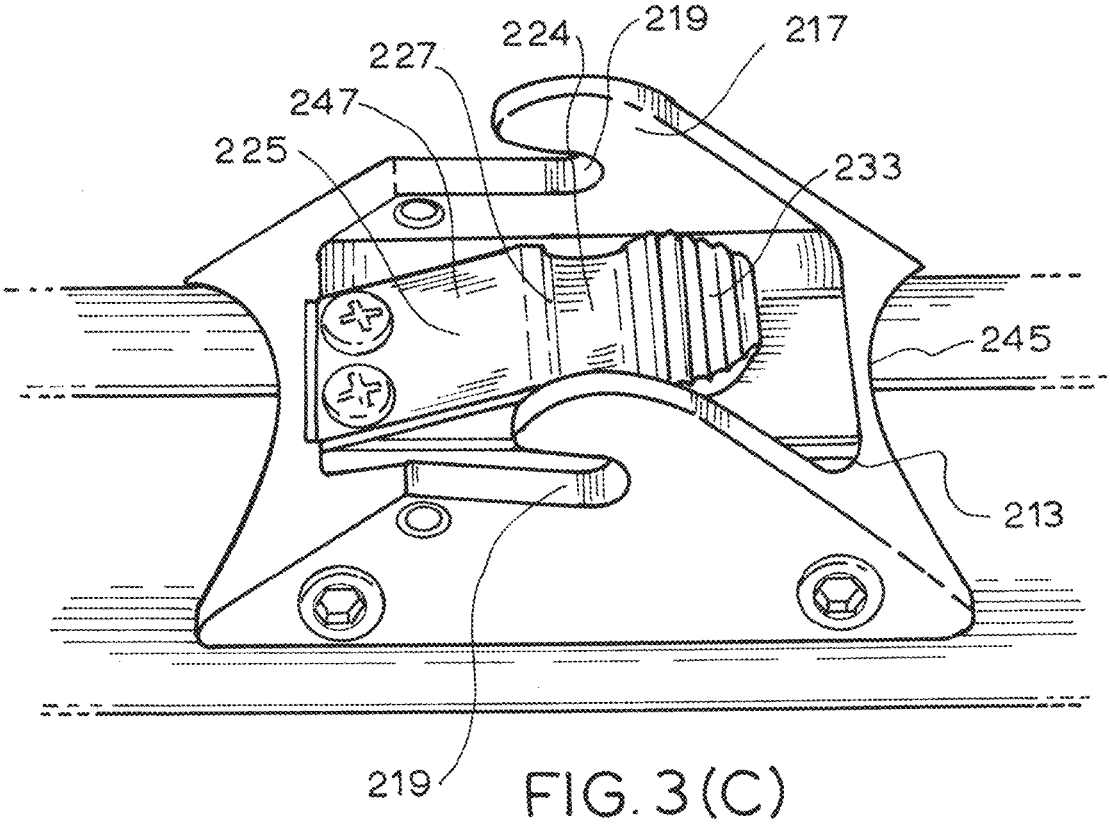
Figure 3D:
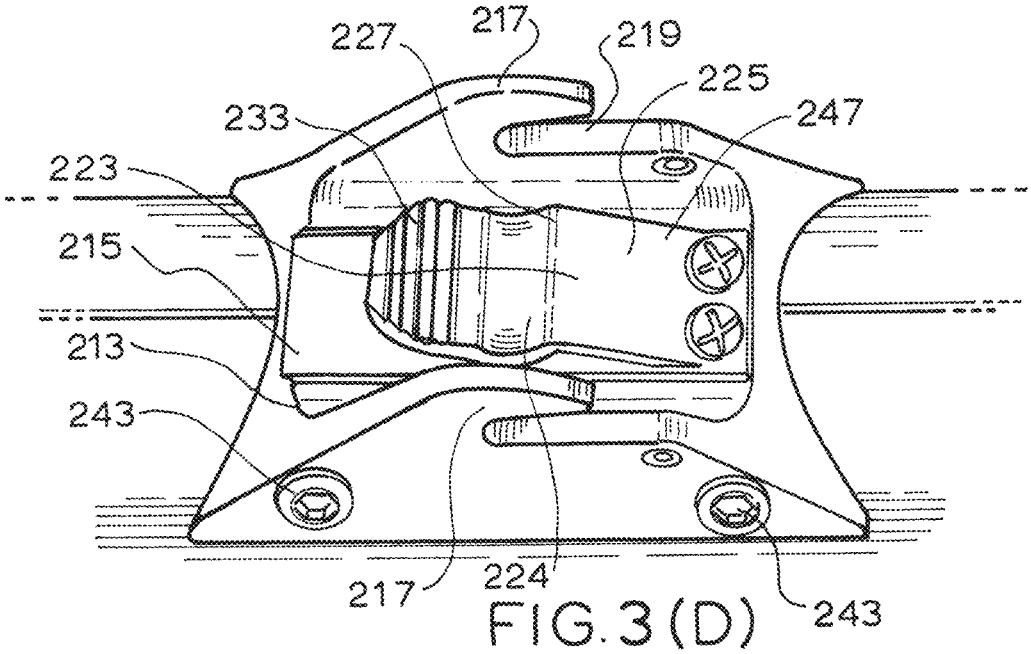
Figure 3E:
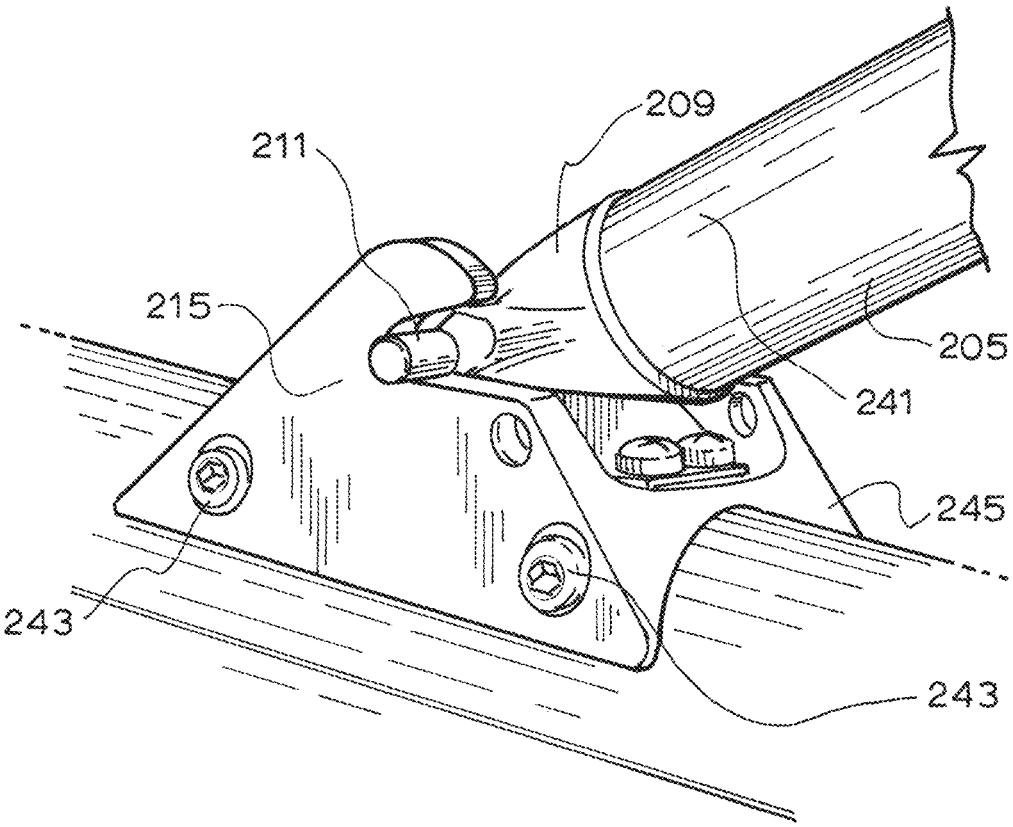

The releasable swivel 201 includes a first support 209 to be fixed to the first spar 205 wherein the first support 209 includes at least one swivel pin 211 that, in use, is configured to extend along the swivel axis 207. The releasable swivel 201 includes a second support 213 that includes a base body 215 to be fixed to the second spar 203. A pair of flanges 217 extend from the base body 215, wherein each flange 217 comprises an open slot 219 to receive the at least one swivel pin 211 of the first support 209. This is illustrated in FIGS. 3(B) and 3(E) that show releasable swivels connecting spars to one another, where FIG. 3(B) and 3(E) have different variations of the first support 209.

The releasable swivel 201 further comprises a releasable catch 223 to retain the at least one swivel pin 211 within the open slots 219 of the flanges 217 such that the first support 209 is coupled to the second support 213. The at least one swivel pin 211 is rotatable within the open slot 219 to allow rotation of the first support 209 relative to the second support 213.

The releasable swivel 201 may be configured so that the at least one swivel pin (211) is received to an in use position at the open slots 219 from a first direction 229 that is substantially perpendicular to the swivel axis 207. The releasable catch 223 may further comprise a locking surface 227 wherein the locking surface prevents movements of the at least one swivel pin 211 in a second direction 231 that is opposite the first direction 229.

The releasable catch 223 may further comprise a trigger 233 to allow a user to selectively release the catch 223, wherein on selective release of the catch 223 the at least one swivel pin 211 is moveable from the open slots in the second direction 231, and wherein the trigger is located outside a pathway of the at least one swivel pin in the second direction 231. This may allow the user to release the catch 223 by operating the trigger 233 with digit(s) of a hand whilst minimising the risk of the moving first support 209, including the swivel pin 211, from hitting and injuring those digit(s).

Construction of the Releasable Swivel 201

Figure 3F:
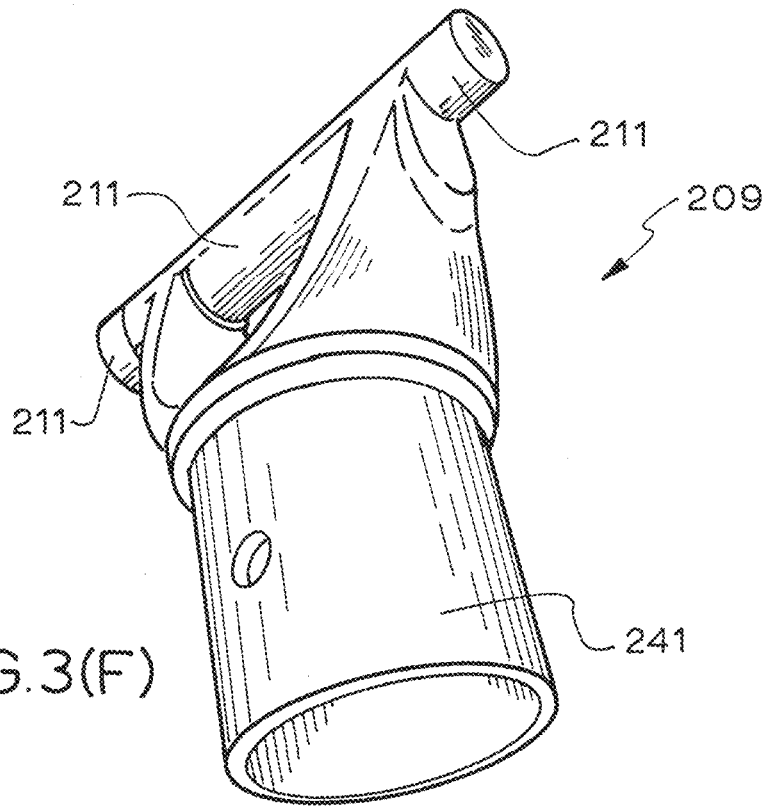

The first support 209 may be fitted to an end of a spar 205, such as the end of the boom 5 or end of the vang tube 7. The first support 209 may include a cylindrical extension 241 to be received in the end of the spar 205 as illustrated in FIG. 3(F). At an opposite end of the first support, the at least one swivel pin 211 is provided. The swivel pin 211 may be affixed to the other parts of the first support 209 in a number of ways. In some examples, the swivel pin 211 is welded or fastened with fasteners to the other parts of the first support 209. In yet other examples, the first support 209 has pins that are integrally formed. In some examples, the swivel pin 211 is a single continuous pin where respective portions of the single pin are received in the open slots 219. In other examples, the at least one swivel pin 211 includes a pair of separate swivel pin portions, wherein each swivel pin portion is received in respective slots 219 of the pair of flanges 217.

The first support 209 may be constructed of metal, such as aluminium, steel, titanium and/or other alloys. In some examples, the parts of the first support 209 may be constructed of different materials. For example, the swivel pin 211 may be made of a harder and more durable material than the cylindrical extension 241, since the swivel pin 211 may be subject to greater friction.

The second support 213 includes a base body 215 that may include one or more mounting apertures 243 to received fasteners to fix the base body 215 to the second spar 203. In the illustrated example the base body 215 further includes a contoured recess 245 that matches with the second spar 203 to assist locating and fixing of the second support 213. For example, the contoured recess 245 may have a radius of curvature that matches the outer diameter of the boom 5 and/or mast 3.

The pair of flanges 217 that extend from the base body 215 may be substantially flat flanges 217 that are parallel to one another and extend perpendicular to the second spar 203. The open slots 219 at the flanges in this example are approximately in a direction parallel to the spar 203. This allows the at least one swivel pin 211 to be received into the open slots 219 from a first direction 229 that is substantially parallel to the spar 203. Once the swivel pin 211 is at the in use position at the open slot 219, the inner surfaces of the slot 219 resist the swivel pin 211 from moving out of the slot 219 (with the exception of the second direction 231 that is opposite the first direction 229). Thus the flanges 217 and open slots 219 function to hold the first support 209 and second support 213 together and should be constructed of material sufficient to withstand the expected forces. In some examples, the flanges 217 may be integrally formed with the second support 213, such as by being moulded, forged or milled.

The releasable catch 223 includes a pawl 225 attached to the base body 215. The pawl is formed of a resilient material to assist the pawl 225 to be biased for the catch 223 to retain the swivel pin 211. The releasable catch includes a cam surface 247 such that when the swivel pin 211 is inserted into the open slots 219 in the first direction, the first support (which in this example is the swivel pin part) interacts with the cam surface 247 to push the pawl 225 to release the catch. This allows the swivel pin 211 to continue through the slots 219 such that the swivel pin is receivable to the in use position in the open slots 219. An advantage of this arrangement is that the user can assemble the components together without having to separately and manually operate the catch 223 (i.e. a "self-locking" catch).

Once the swivel pin 211 is in place, the pawl 225 may be biased to the locking position so that the locking surface 227 prevents movement of the at least one swivel pin 211 in a second direction 231. Thus this prevents the at least one swivel pin 211 from exiting the slots 219.

The pawl 225 also has a locking recess 224 which may be rounded. The locking surface 227 may be part of the locking recess 224. The locking recess 224 may provide a smooth bearing surface against the swivel pin 211 to assist smooth relative rotation of the pin 211.

The trigger 233 is located outside of the pathway of the at least one swivel pin 211 in the second direction. This reduces the chance that a user's fingers may be caught when coupling the first support 209 and second support 213 together. The trigger 233 may simply be an extension of the pawl 225. However, it is to be appreciated that the trigger 233 may be a separate component that interacts with the pawl 225, or other part of the releasable catch 223.

The direction of the open slots 219 may be selected based on requirements for the swivel. One requirement may be based on the direction that the first spar 205 is expected to approach the second spar 203 during coupling. Another requirement is based on the expected forces between the first and second spar. For example, it may be desirable to direct the larger forces to be resisted by the flanges 217 so that such forces are not borne on the releasable catch 223, which may have a lower force rating, to decrease wear, and/or for ease of releasing the catch 223. In the illustrated example of FIG. 1, the releasable swivel 201' has an open slot 219 that is directed substantially upwards (so that the swivel pin 211 will be received from the top down). The other releasable swivel 201" has an open slot that is directed horizontally and towards the intersection 9. This may ensure that the greatest amount of force imparted through the swivel pin 211 and to the second support 213 is against the pair of flanges 217 instead of the catch 223.

In the above example, the releasable catch 223 included a resilient pawl 225 to retain the at least one swivel pin 211. Thus the releasable catch 223 may be constructed of plastics, metal, rubber or combinations thereof.

However it is to be appreciated that other mechanisms for retaining a pin in a slot may be suitable. In some examples, the pawl may be a rigid element biased by a separate spring. In other examples, the releasable catch 223 may include a manually operable latch to prevent the swivel pin 211 from moving out of the slot 219, which requires the user to manually and selectively open and close the catch.

The Connection 301

Referring to FIGS. 4(A) to 4(J), a connection 301 for transferring a force from a spar 307 (e.g. vang tube 7) to a mast 3 of a sailboat. The connection 301 includes a connection base 303 having a key portion 305 to be received in a keyway 306, where the keyway 306 is part of a sail track 107 of the mast 3 (see FIG. 4(F) that illustrates an end view of the sail track 107 that receives the key portion 305 and FIG. 4(G) that shows an end view of the connection base 303 including the key portion 305. The connection also includes a mount 309 to receive the spar 307, wherein the force from the spar 307 is transmitted through the mount 309 to the connection base 303. The connection further includes a restraint 311 to resist a first component force acting on the connection base 303, wherein the first component force is a component of the first force transmitted from the spar 307 that is in a direction parallel to the keyway 306 and mast 3. The second component force 39, that is in a direction perpendicular to the keyway 306 and mast 3, is transmitted through the connection to the mast 3.

The restraint 311 may include an aperture 313 to receive cordage 315 tensioned to limit movement of the connection base 303 in the keyway 306. The length of cordage may be selectively adjustable to adjust a location of the connection base 303 along the keyway 306. In some embodiments, the cordage 315 may be associated with a pulley system to assist the user adjusting the length and/or tension of the cordage 315 as required.

Since the key portion 305 is received in the keyway 306 (which is part of the sail track 107), this may allow at least part of the connection 301 to be fitted to the sailboat without using additional components or drilling additional holes in to the mast 3. As the sail track 107 is part of the sailboat, this provides a simplified system that may lower the number of components, weight and/or cost of the overall sailboat. In addition, having a connection base 303 that can be adjustable along the keyway 306 may allow the user to vary the characteristics of the rigging system. In particular, when the connection 30 is used with the vang tube 7, this adjustment may assist in achieving the desired transfer of force from the boom 5 to the mast 3.

The connection base 303 may further include a socket 317 to receive a corresponding bearing 319 of the mount 309

Figure 4A:
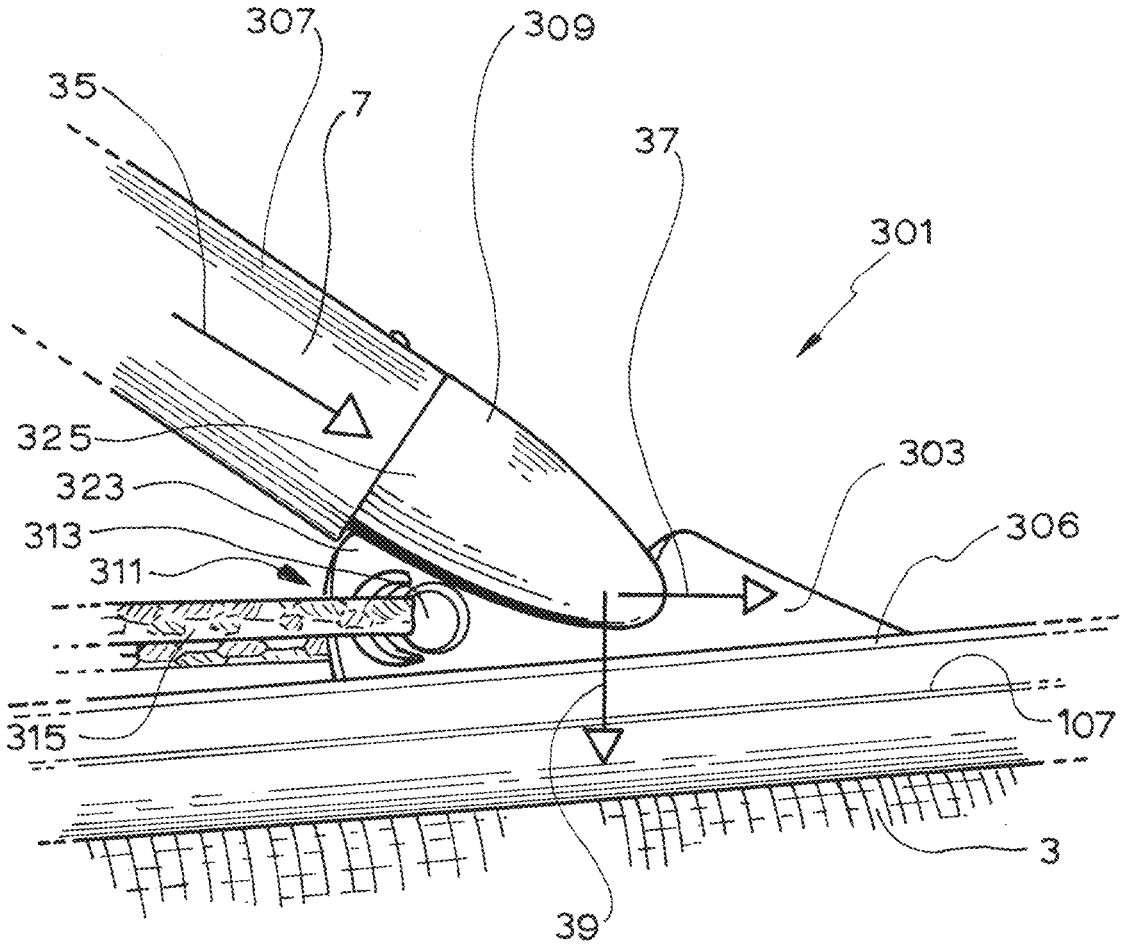
FIGS. 4(A) to 4(J) are views of a connection of the rigging system.
Figure 4B:
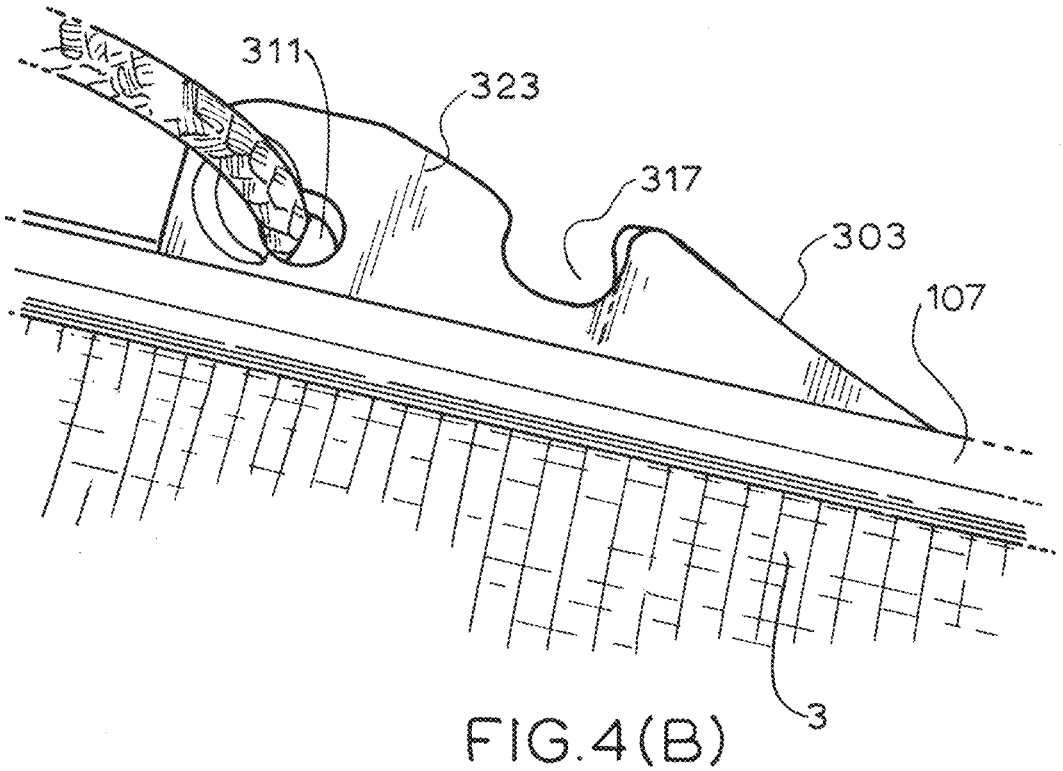
Figure 4C:
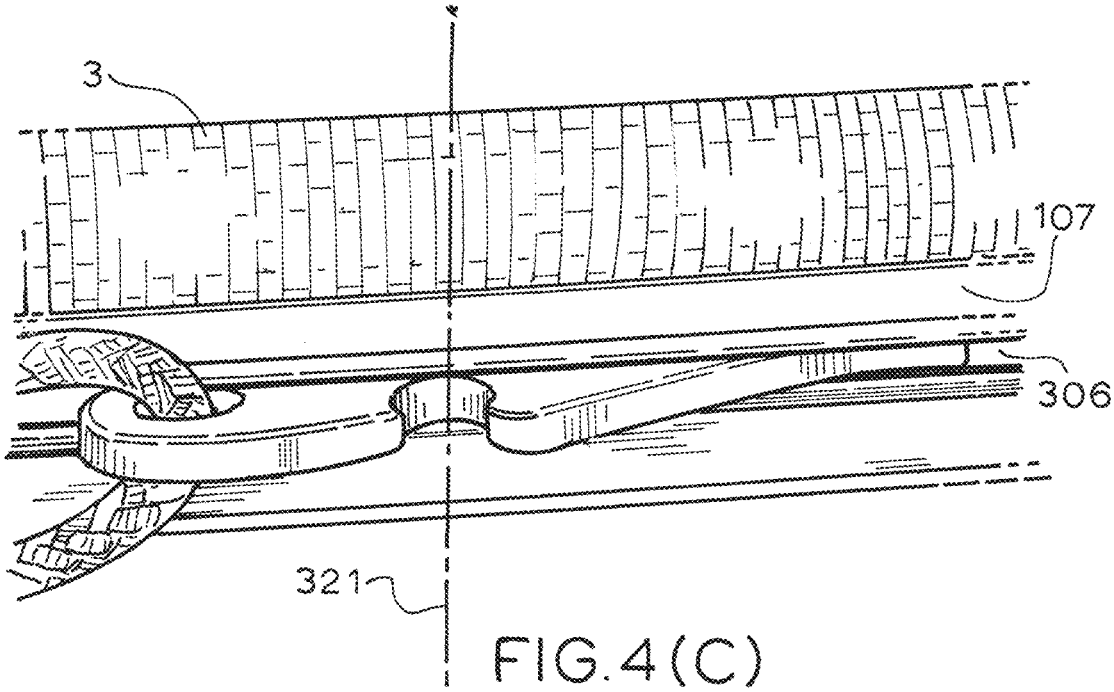
Figure 4D:
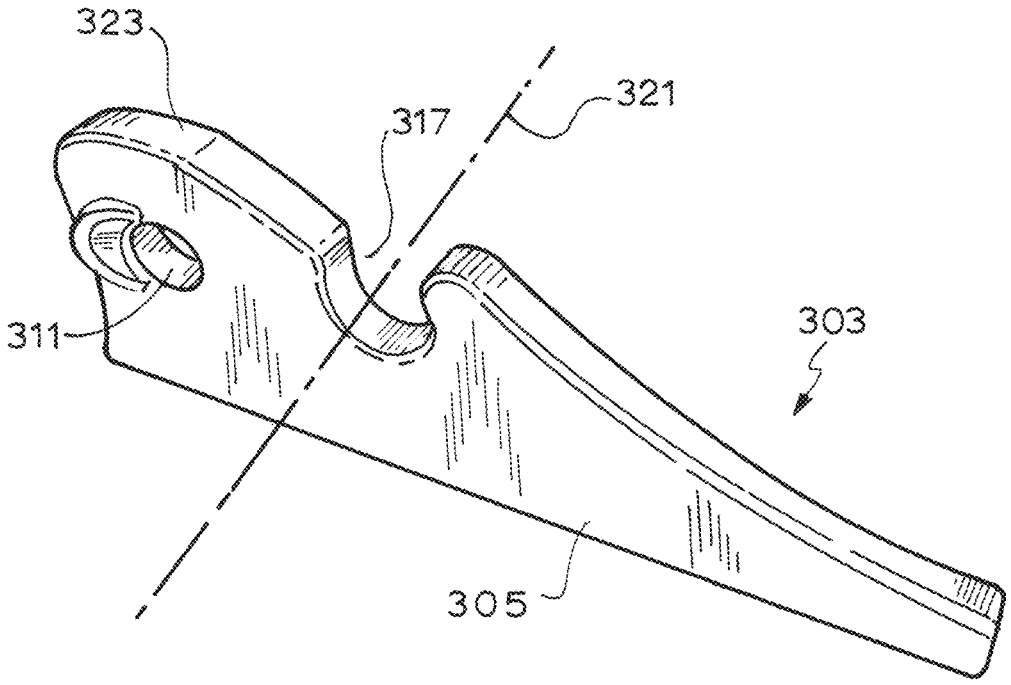
Figure 4E:
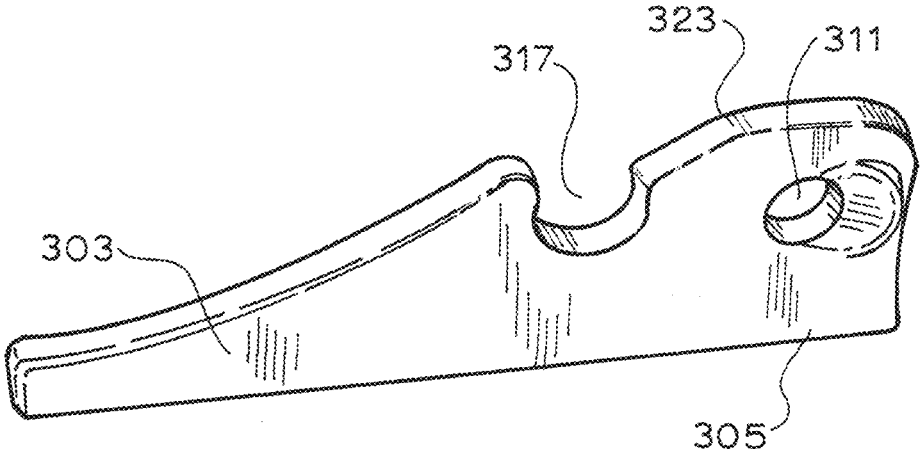
Figure 4:
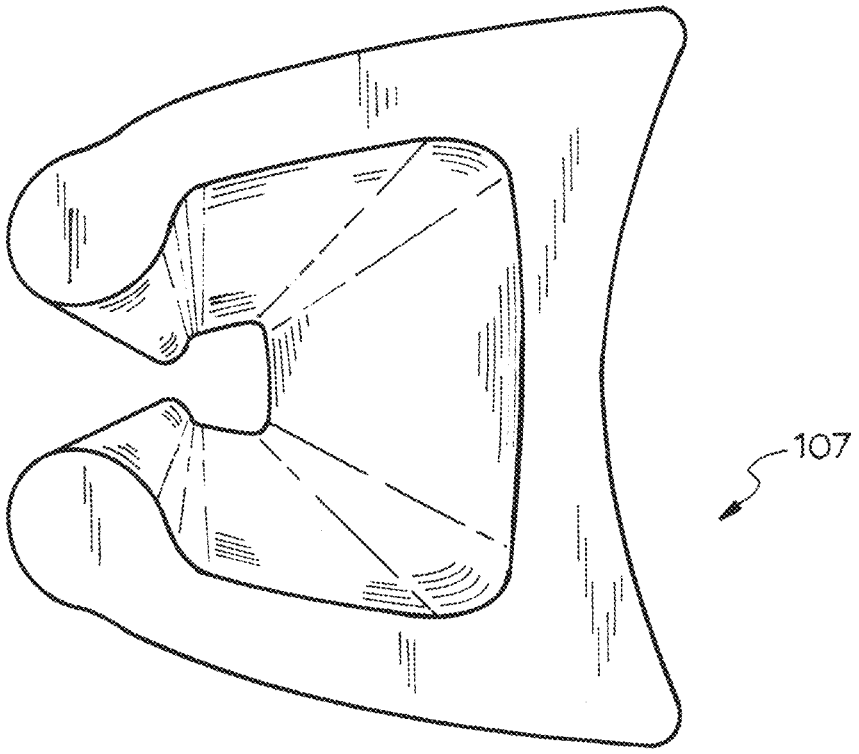
Figure 4:
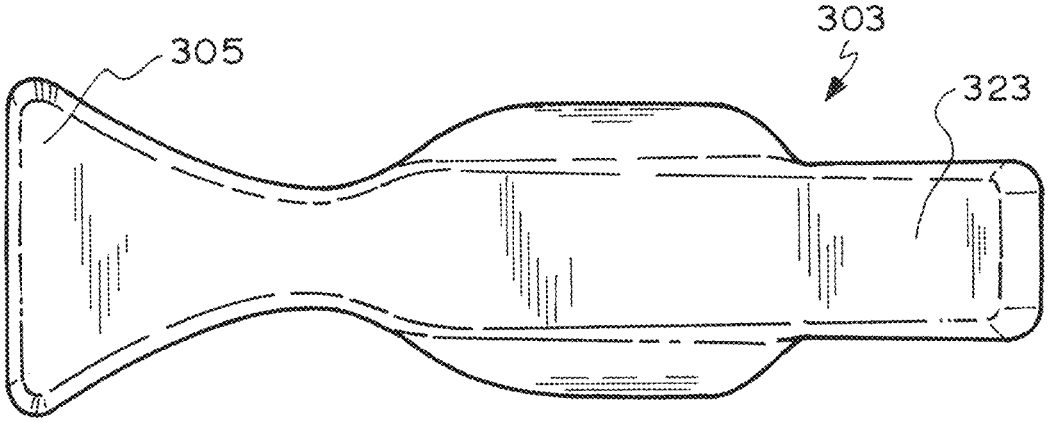
Figure 4:
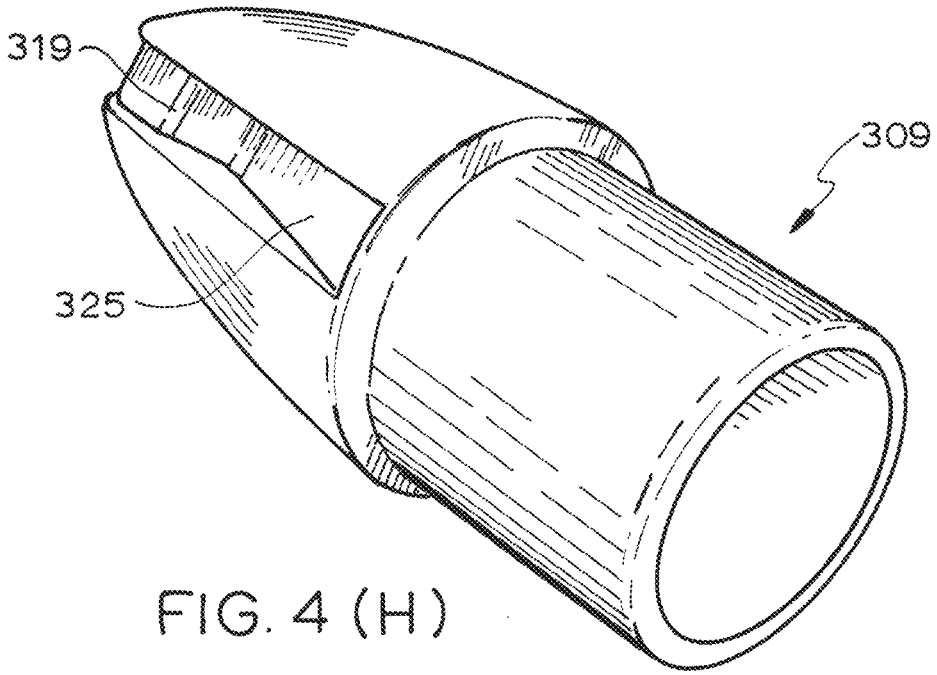
Figure 4:
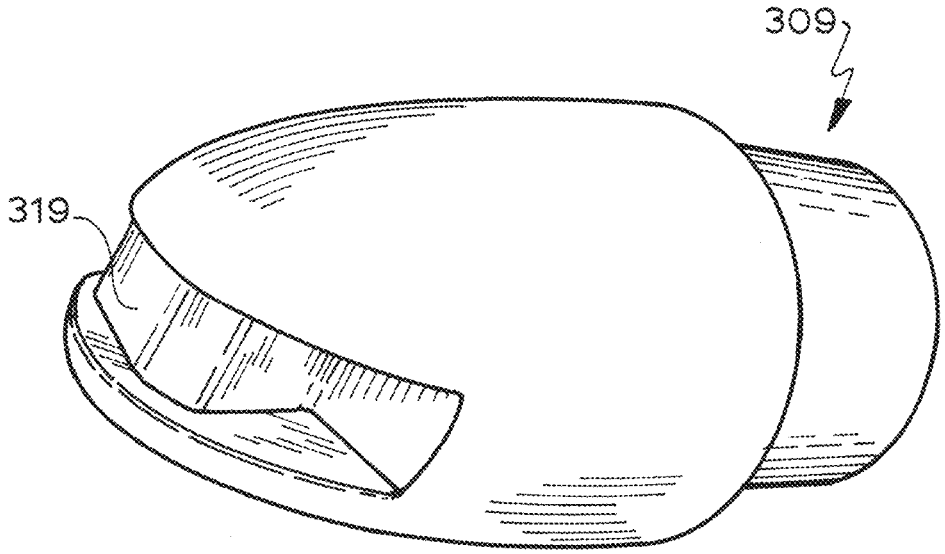
Figure 4J:
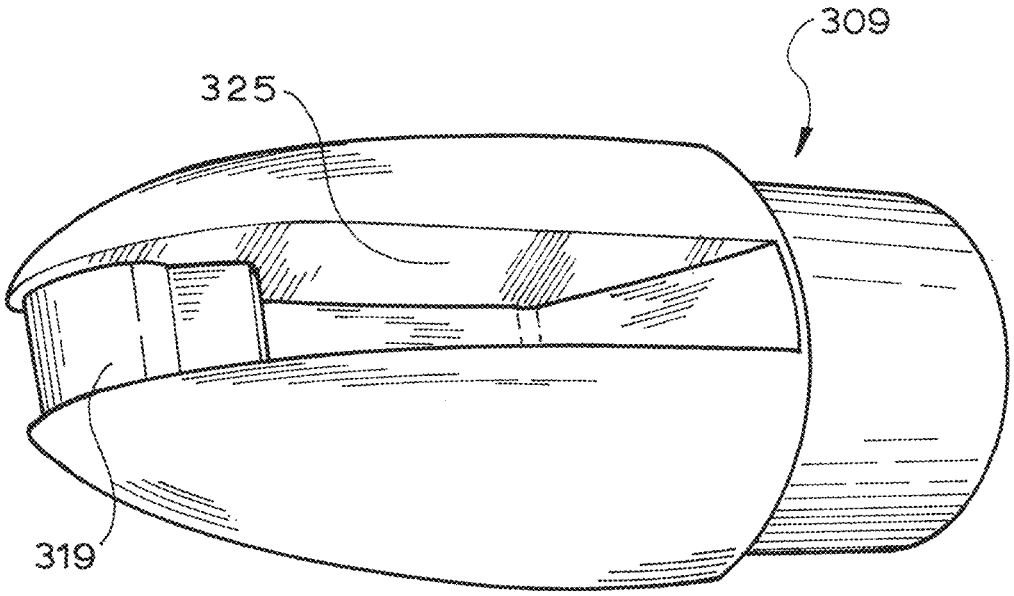

(see FIGS. 4(H) to 4(J)). The bearing 319 of the mount 309 is inserted into the socket 317 such that the first force 35 is transmitted from the bearing 319 of the mount to the socket 317 of the connection base 303. Furthermore, the bearing 319 and socket 317 allows the mount 309 to be rotatable, at least to a range of degrees, relative to the connection base 303 around a connection axis 321 (see FIG. 4(D)) that is horizontal and perpendicular to the keyway 306. The socket 317 and bearing 319 may also allow the connection base 303 and mount 309 to be separable when not in use. This may allow the user to easily disassemble to the rigging system 1 when not in use (i.e. allowing the user to easily detach the vang tube 7 from the mast 3). For example, the user may simply release the cordage 315, which in turn allows the mount 309 and connection base 303 to be separated.

To assist smooth relative rotation, the socket 317 may include an arcuate surface to receive the bearing 319. In turn, the bearing 319 may also include an arcuate surface (such as a bulbous portion) to bear against the arcuate surface of the socket. This may also assist in the transfer of force between the mount 309 and connection base 303, and in particular ensuring the force is transferred over a greater surface area of the bearing 319 and socket 317.

The connection base 303 may further comprise an insert portion 323 that is receivable in a corresponding recess 325 of the mount 309. The insert portion 323 is received in the recess 325 to resist relative movement of the mount 309 and the connection base 303 in a direction along the connection axis 321. It is to be appreciated that alternative configurations to resist movement in a direction along the connection axis 321 may be used. For example, the mount 309 may have a pair of flanges wherein the insert is received in the pair of flanges to prevent relative movement along the connection axis 321. In other alternatives, the insert portion may be on the mount and the corresponding recess may be on the connection base.

The connection base 303 and the mount 309 may be constructed out of metals such as aluminium, steel, titanium and/or other alloys. In other examples one or more of these components may be made out of plastics or composite materials.

Variations

Another example of a rigging system will now be described with reference to FIGS. 9(A) to 11(G).

Figure 9A:
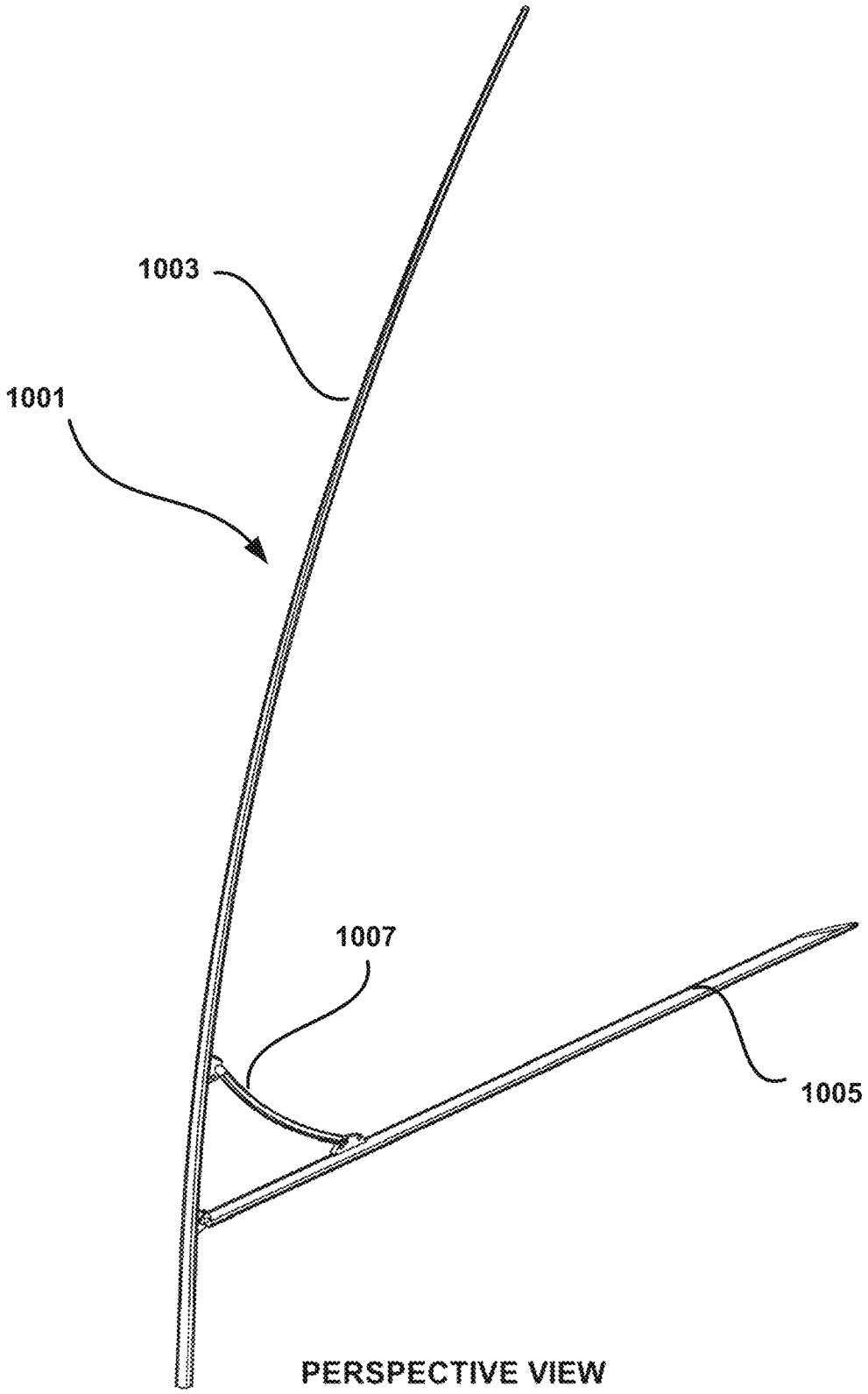
FIGS. 9(A) to 9(C) illustrate views of a variation of the rigging system.
Figure 9B:
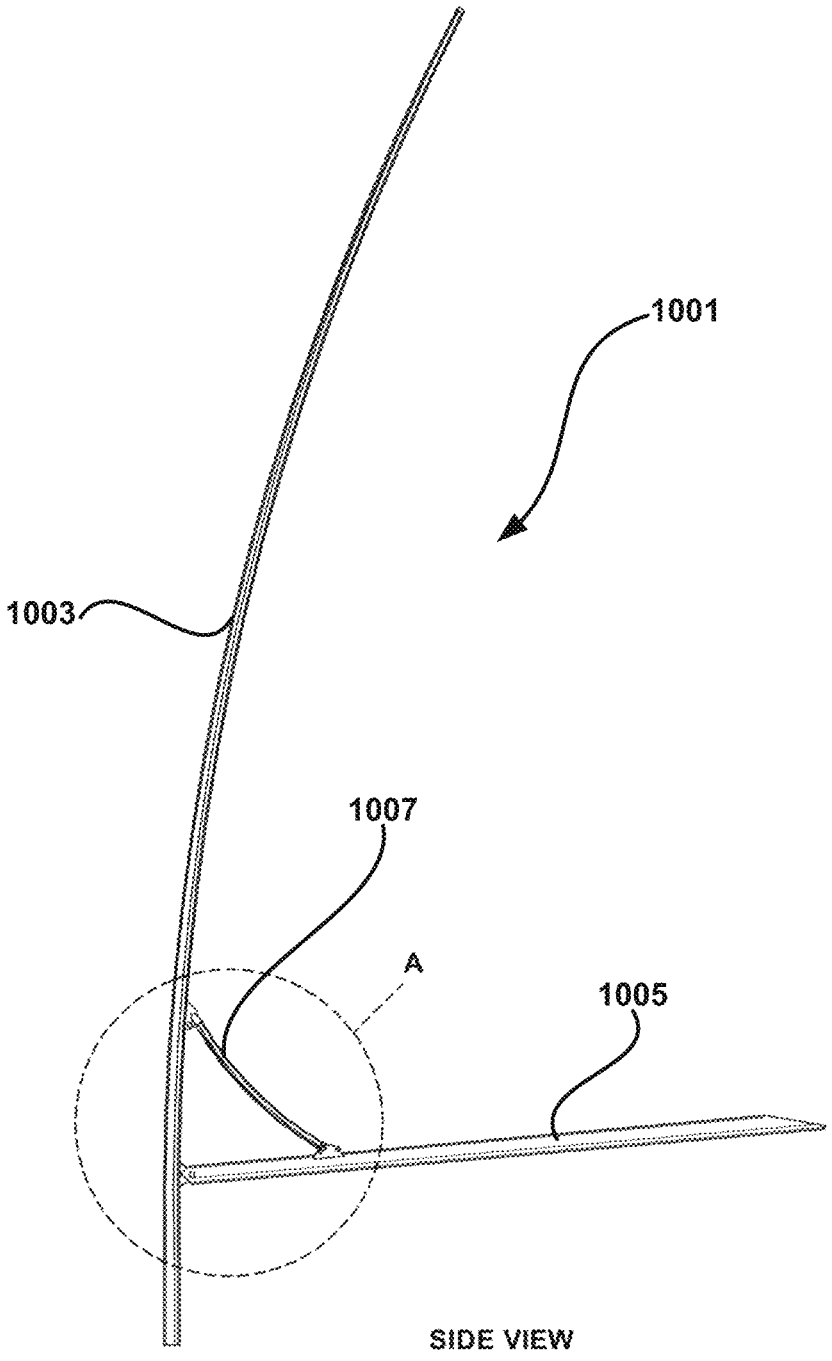

FIGS. 9(A) and 9(B) illustrate a rigging system 1001 that includes a mast 1003 that extends upwards with a curvature towards a stern of a sailboat. A boom 1005 extends horizontally from the mast 1003. Similar to the above mentioned examples, a vang tube 1007 extends between the mast 1003 and the boom 1005 to resist relative force and/or moments of the boom 1005 towards the mast 1007.

Figure 9C:
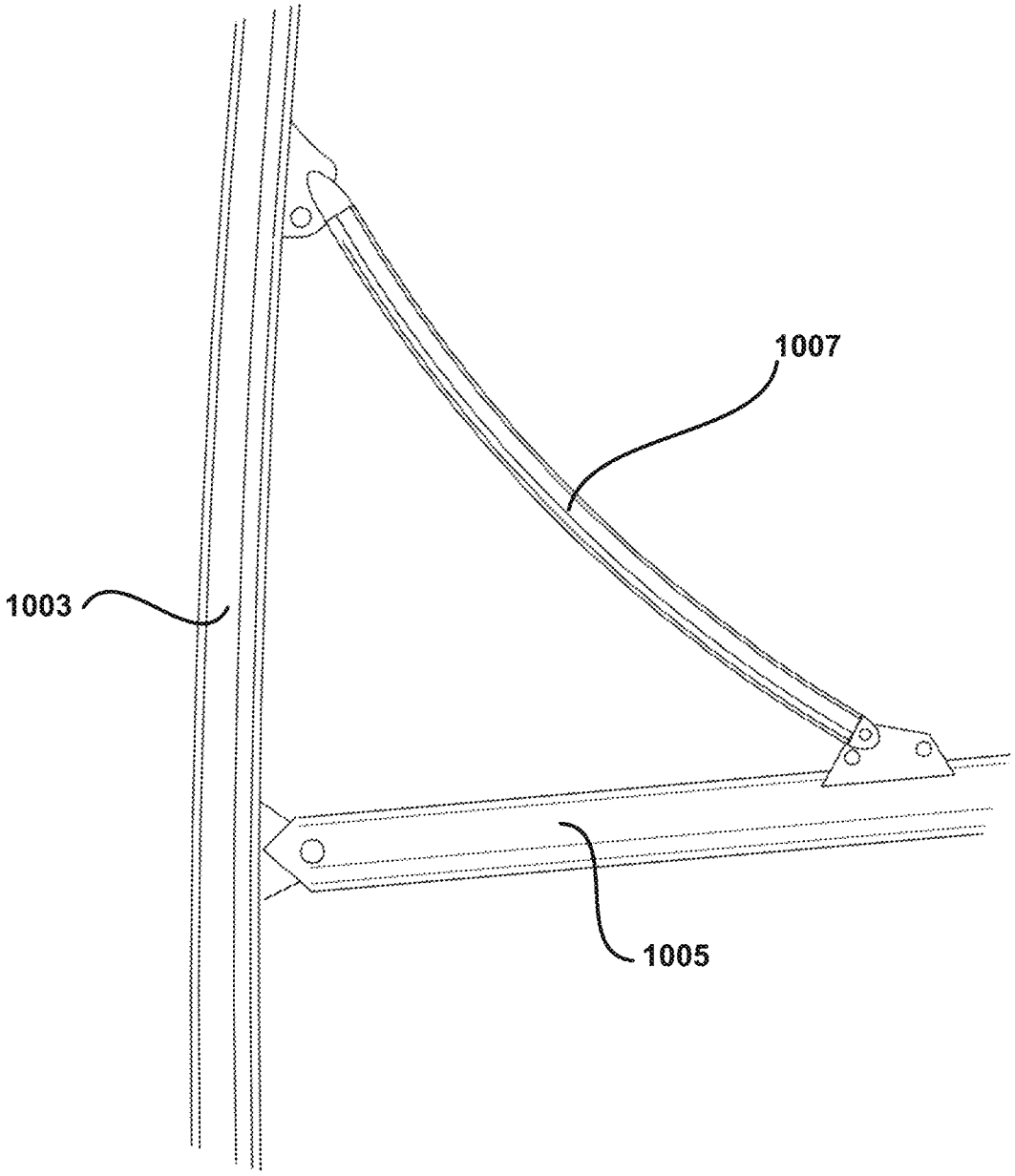

FIG. 9(C) is an enlarged view of area A from FIG. 9(B) that shows the vang tube 1007 above the boom 1005 and aft of the mast 1003.

Figure 10A:
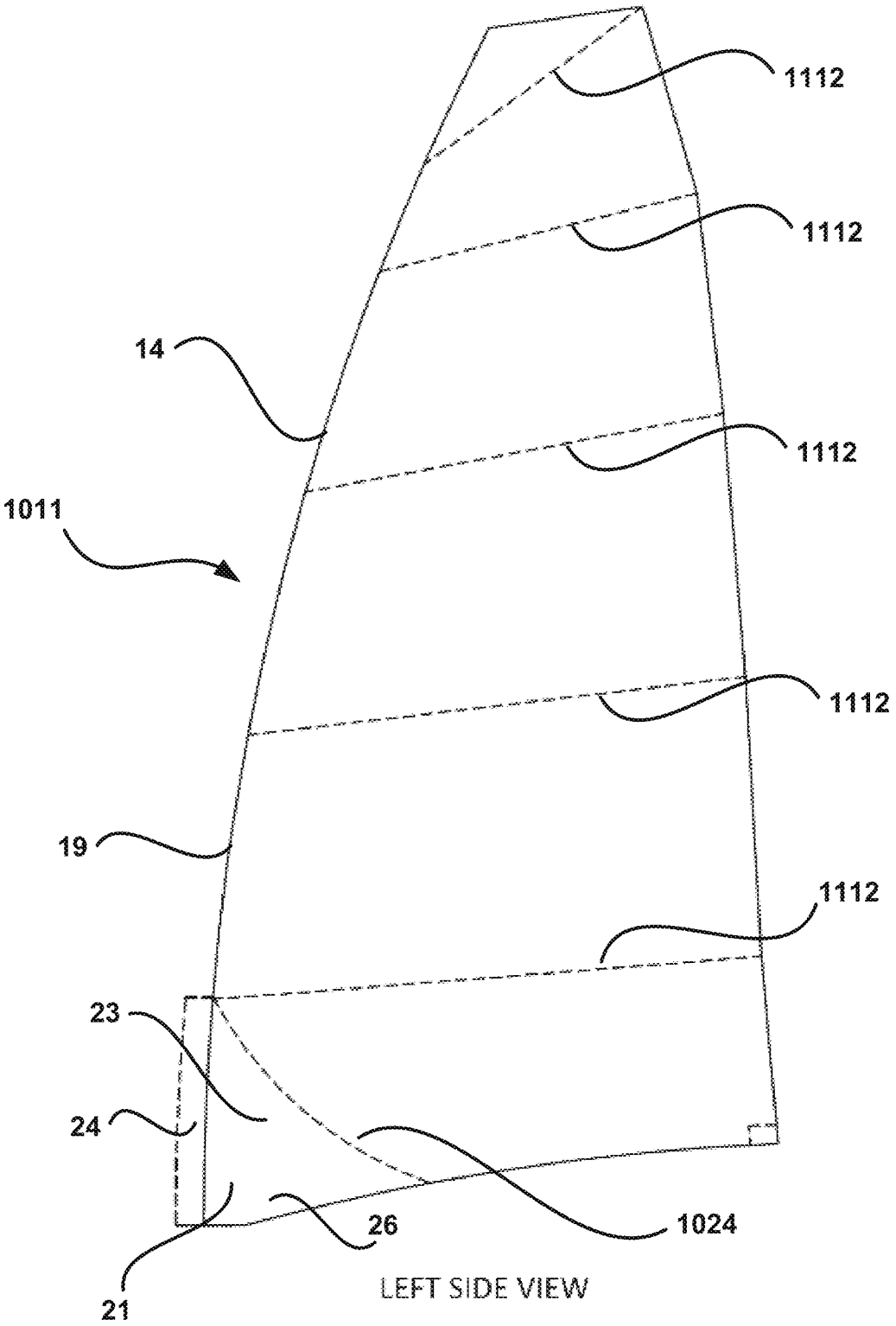
FIGS. 10(A) to 10(C) illustrate views of a sail for use with the rigging system of FIGS. 9(A) to 9(C)
Figure 10B:
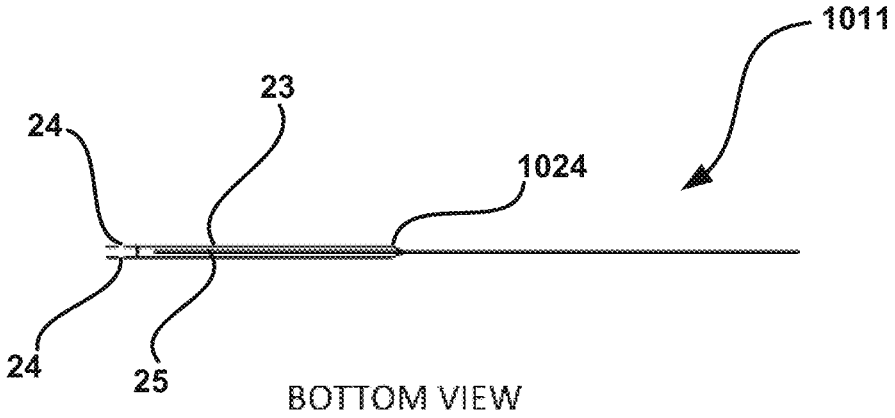
Figure 10C:
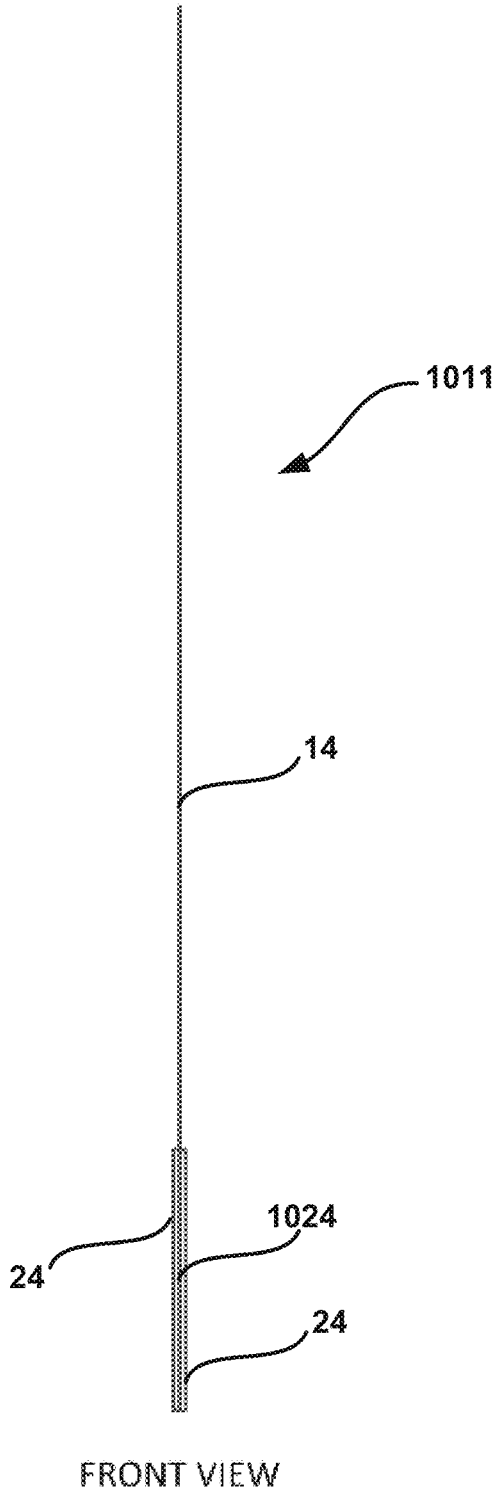

FIGS. 10(A) to 10(C) illustrate a sail 1011 for the rigging system 1001. The sail 1011 may receive one or more battens 1112 to assist in shaping of the sail 1011. Similar to the above examples, the sail 1011 has two sheet portions 23, 25 proximate the luff 19 in an area close to the tack 21. Referring to the bottom view in FIG. 10(B), this includes a first sheet portion 23 and a second sheet portion 25 so that when the sail 1011 is rigged the vang tube 1007 passes between the sheet portions 23, 25. The first and second sheet portions 23, 25 meet at a seam 1024. In this example, the seam 1024 is curved to follow (at least approximately) the curve of the vang tube 1007. From the seam 1024 onwards (towards the leech) the sail continues substantially as a single sheet (or joined sheets).

The sail 1011 may also include one or more flap portions 24 at the lower leading edge that extend from the sheet portions 23, 25. The flap portions 24 may be fastened to one another (such as with hook and hoop fasteners) such that in use, the flap portions 24 wrap around the mast 1003. The flap portions 24 may assist in providing a smooth transition for airflow from the mast 1003 to the first and second sheet portions 23, 25 that are on opposite sides of the curved vang tube 1007. The flap portions may also assist in securing the sail 1011 to the mast 1003. In some variations, a single flap portion 24 may wrap around the mast 1003 and be fastened to the opposite sheet portion 23, 25 of the sail 1011.

Towards the tack 21, the sheet portions 23, 25 also has sheet extensions 26 that extend downward such that in use, the sheet extensions 26 extend to either side of the boom 1005. This may assist in maintaining air pressure at the sail 1011 in the region between the vang tube 1007 and the intersection of the mast 1003 and boom 1005.

Figure 11A:
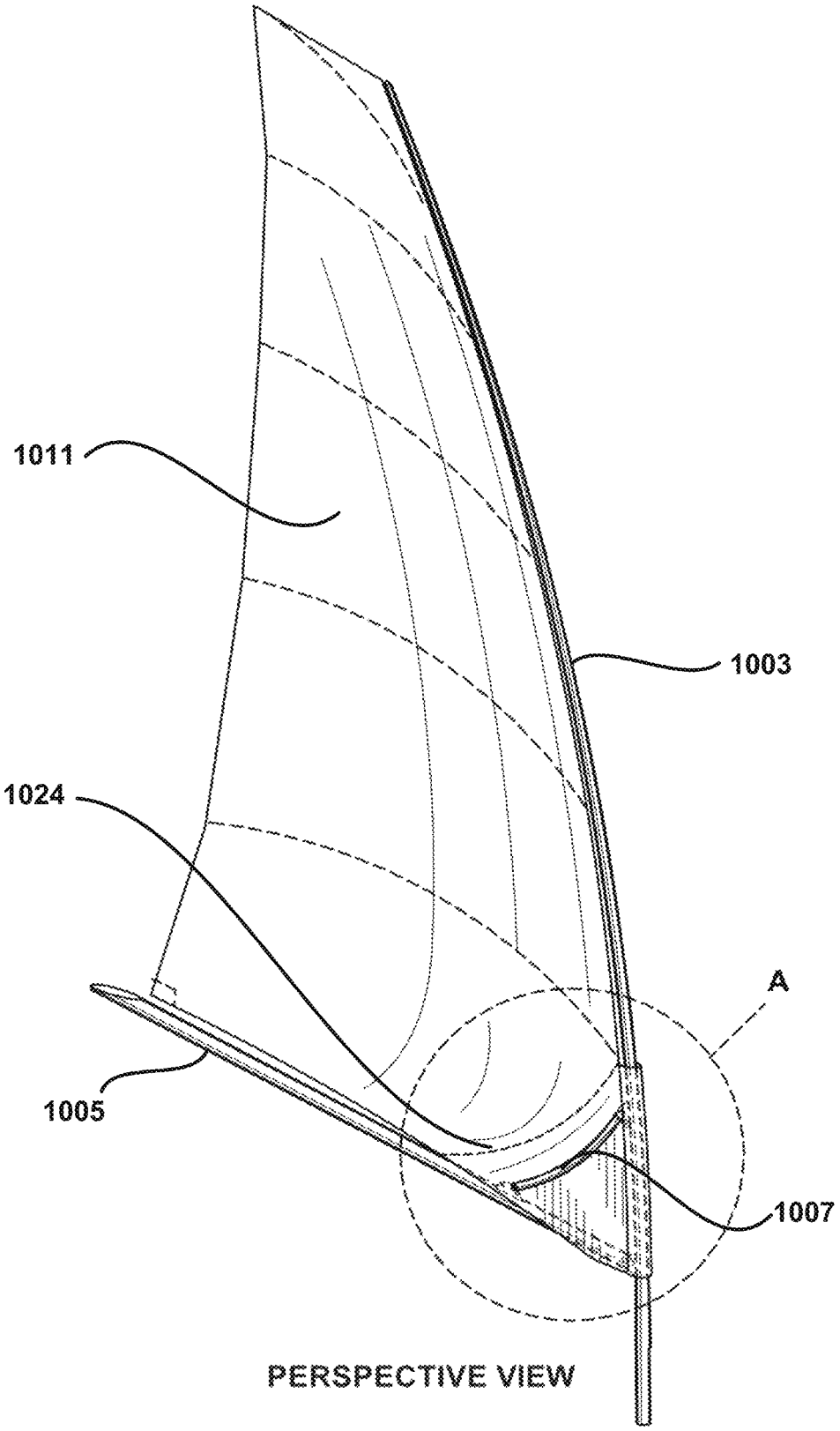
FIGS. 11(A) to 11(G) illustrate the sail of FIGS. 10(A) to 10(C) rigged to the rigging system of FIGS. 9(A) to 9(C)
Figure 11B:
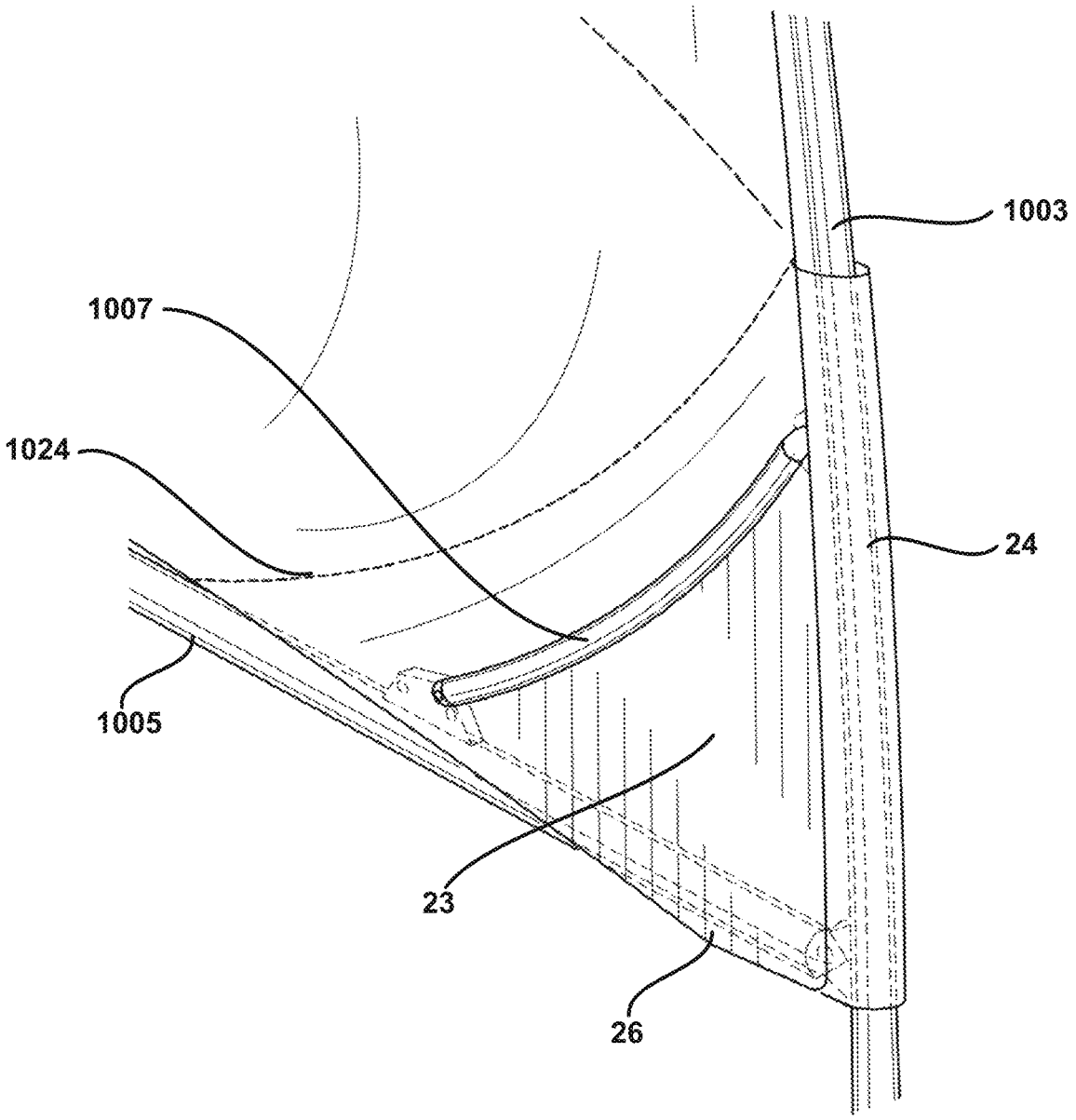
Figure 11C:
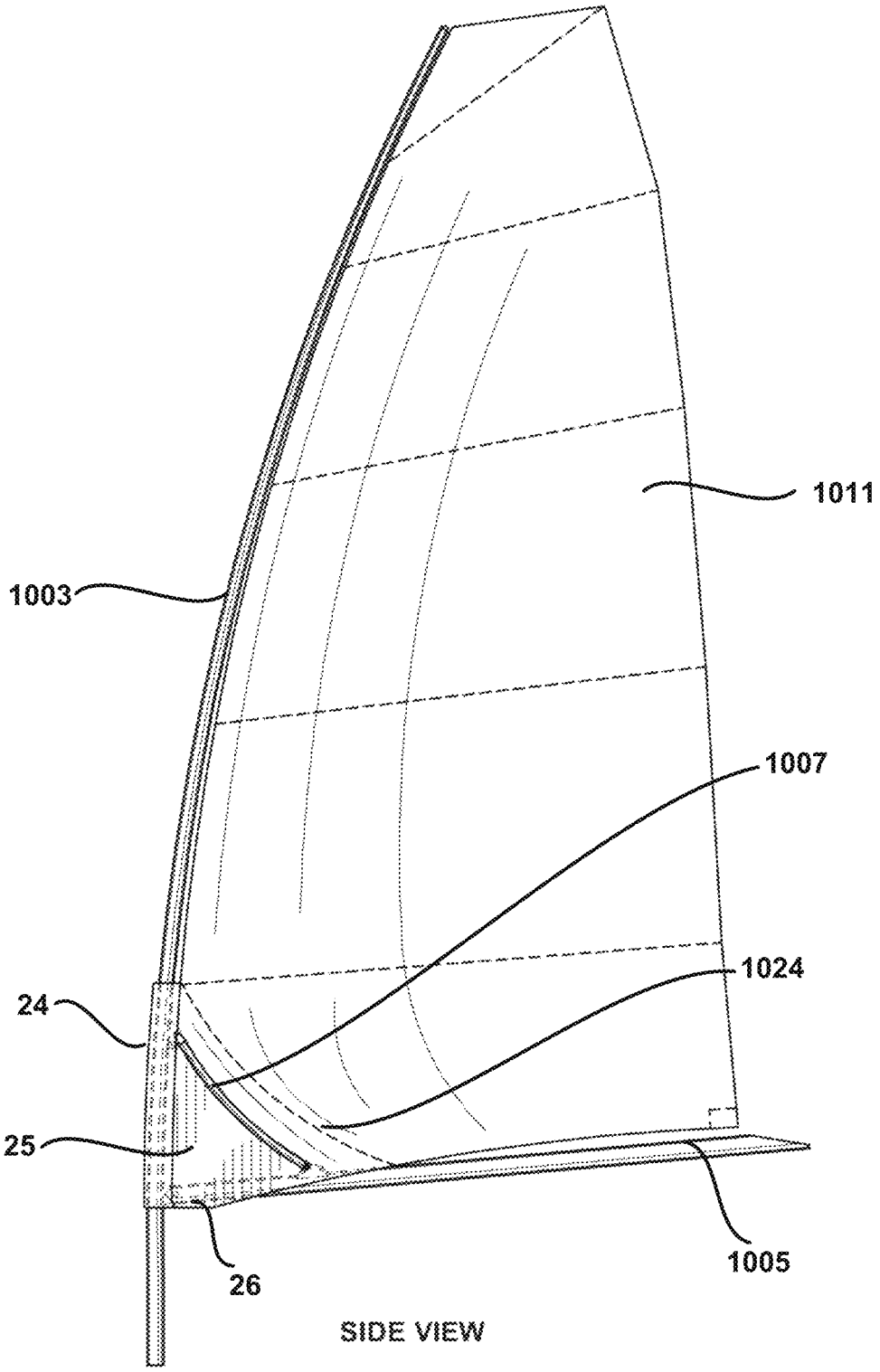
Figure 11D:
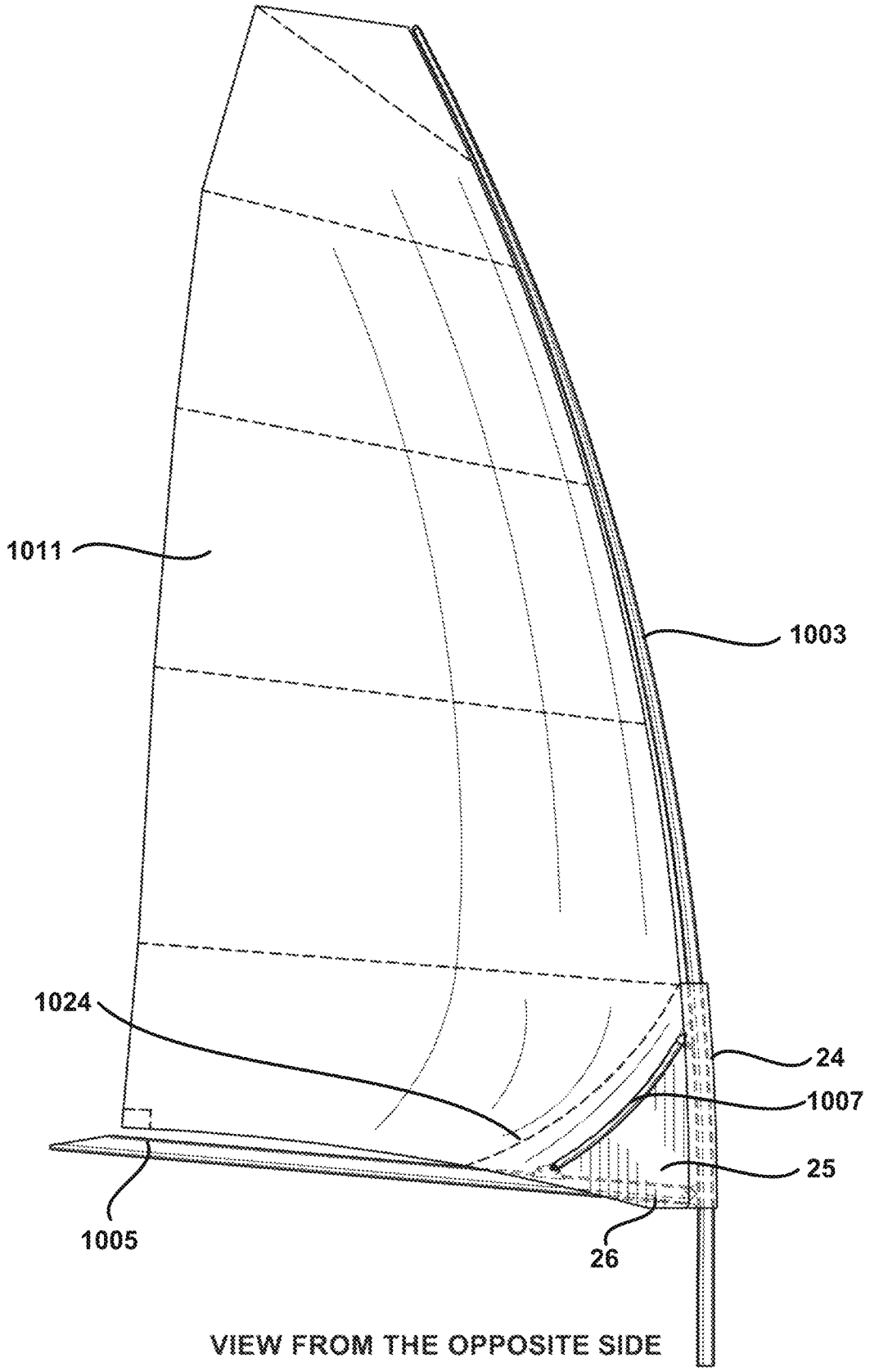
Figure 11E:
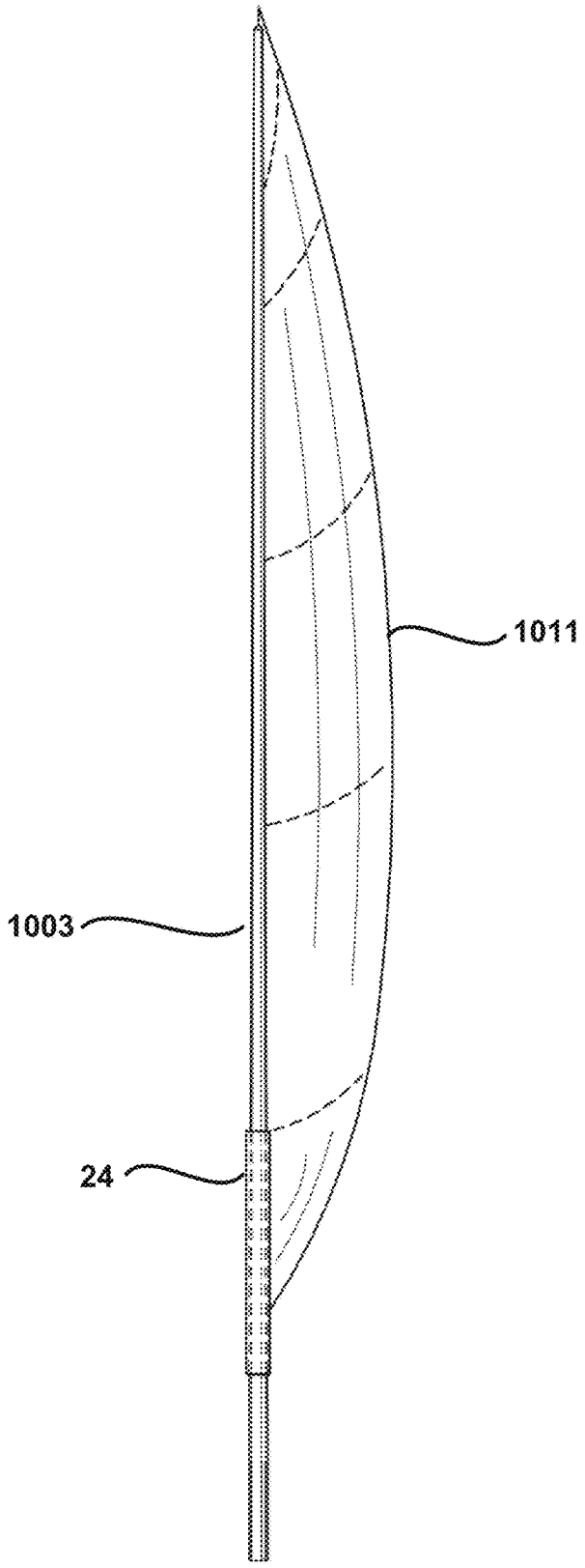
Figure 11F:
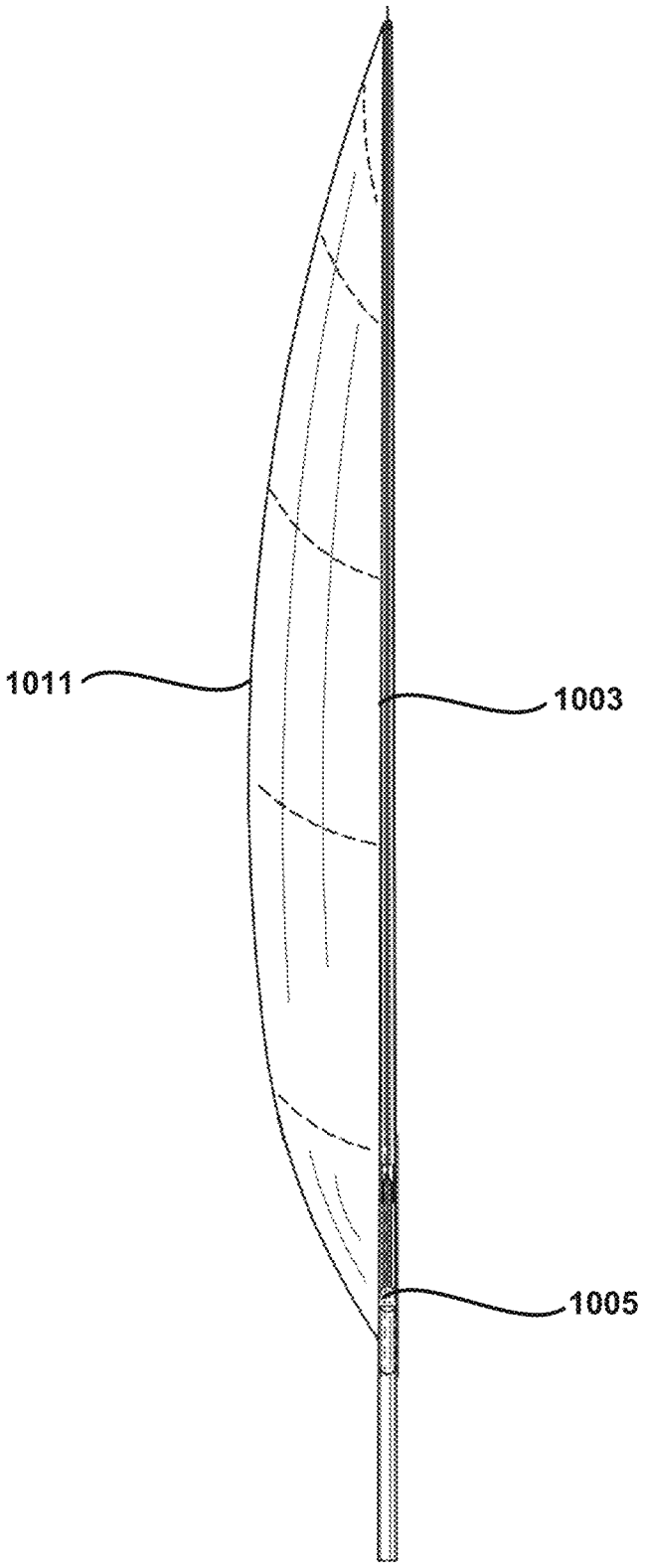
Figure 11G:
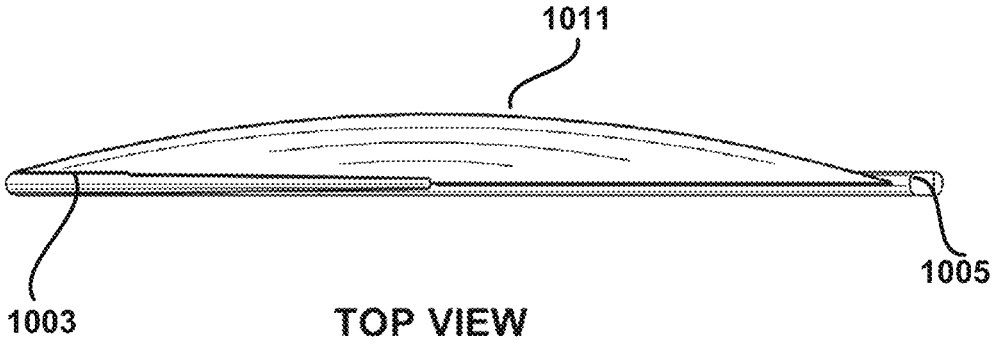

FIGS. 11(A) to 11(G) illustrate the sail 1011 of FIGS. 10(A) to 10(C) rigged to the rigging system 1001 of FIGS. 9(A) to 9(C). FIG. 11(B) is an enlarged perspective view of area A in FIG. 11(A) and shows the first sheet portion 23 over the curved vang tube 1007 (and the second sheet portion 25 is over the opposite side of the curved vang tube 1007).

This shows the flap portions 24 extending from the sheet portions 23, 25 and wrapping around the mast 1003. Furthermore the flap extensions 26 extend, at least in part, over the boom 1005. This also shows the seam 1024 that follows the curved vang tube 1007.

Figure 12A:
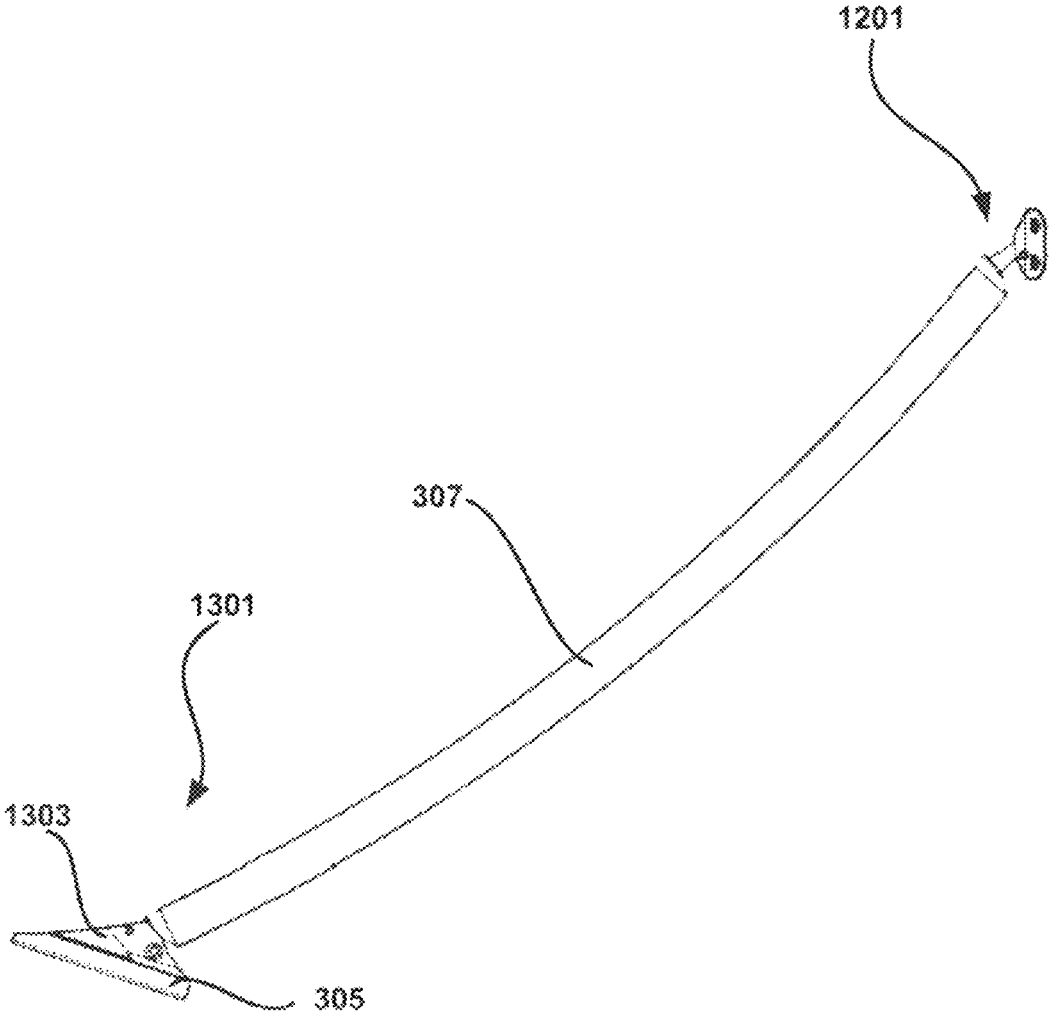
FIGS. 12(A) to 12(G) illustrate a variation of the connection and swivel.

A variation of the connection 1301 and swivel 1201 will now be described with reference to FIGS. 12(A) to 12(G). Referring to FIG. 12(A), the curved vang tube 307 has the connection 1301 at one end to connect with the mast and the swivel 1201 to couple the vang tube 307 to the boom.

Figure 12B:
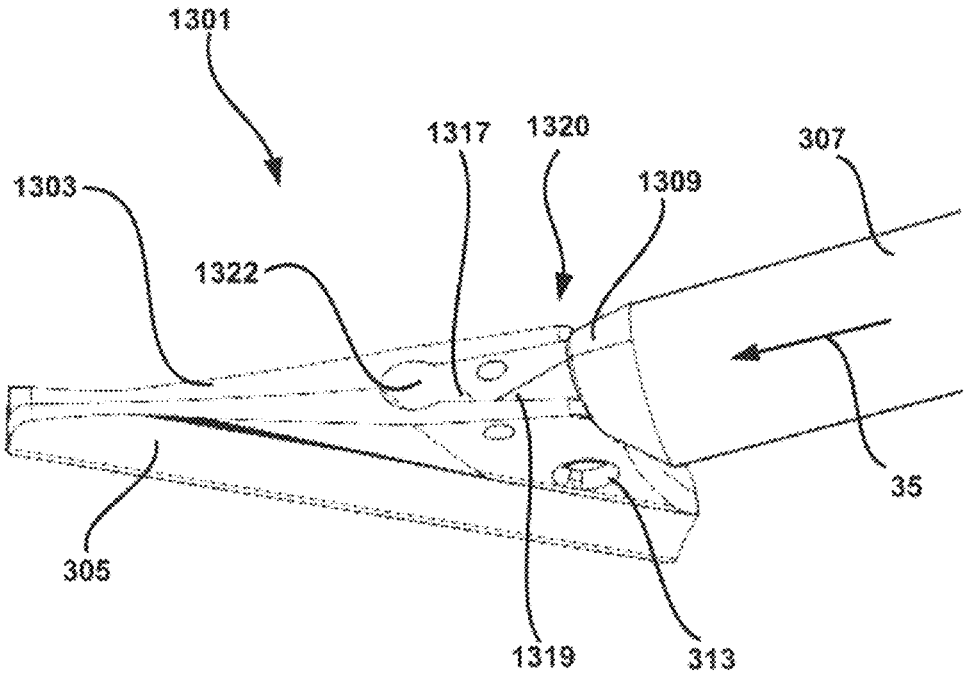
Figure 12C:
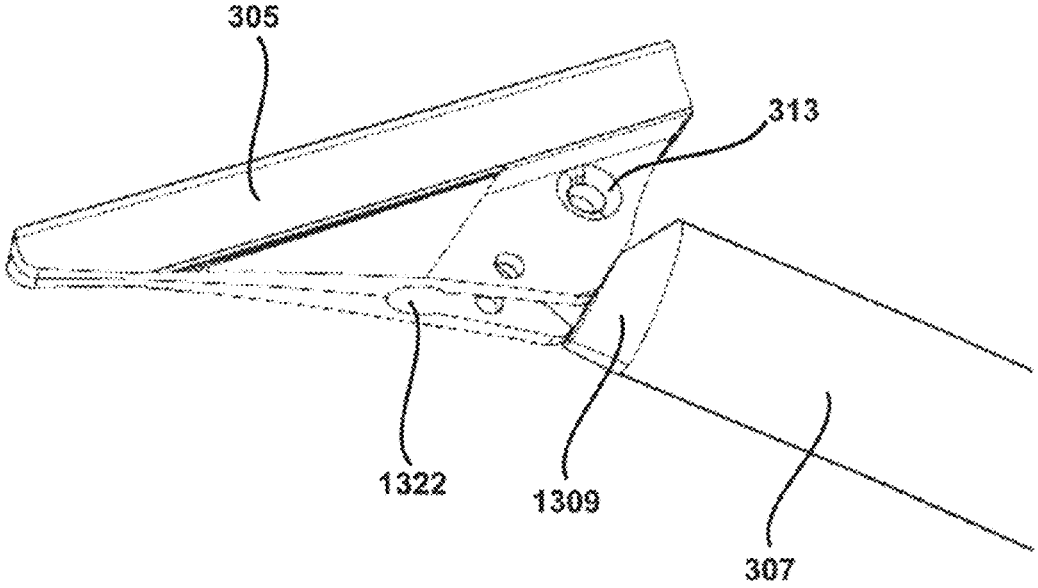
Figure 12D:
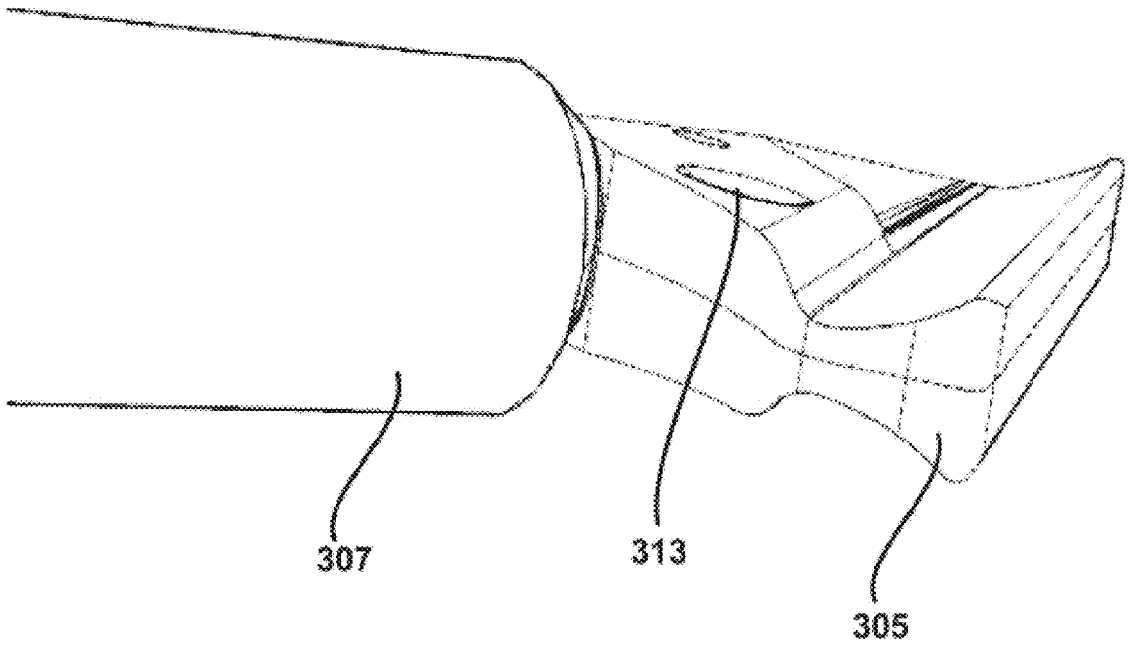

The connection 1301, as illustrated in FIGS. 12(B) to 12(D), includes similar features to the connection 301 described above unless described otherwise below. The connection 1301 includes a connection base 1303 that has a key portion 305 to be received in the keyway 306. The connection 1301 also includes a mount 1309 to receive the vang tube 307. The connection base 1303 and the mount 1309 are joined at joint 1320 that is in the form of a ball and socket joint. The ball and socket joint allows, at least partial, relative rotation of the connection base 1303 and mount 1309. This may include relative rotation in two or three axes.

In the illustrated example, the ball 1319 is associated with the mount 1309 and the socket 1317 is formed, at least in part, between two flanges of the connection base 1303. A ball track 1322 is provided in the connection base 1303 so that the ball 1319 may be selectively inserted and removed from the socket 1317. The ball track 1322 may include a ball track direction that is substantially perpendicular to the first force 35 transmitted from the mount 1309 to reduce the likelihood of the first force 35 from forcing the ball 1319 out of the socket 1317. In some examples, the ball track 1322 may include a non-linear track to the socket 1317.

Figure 12E:
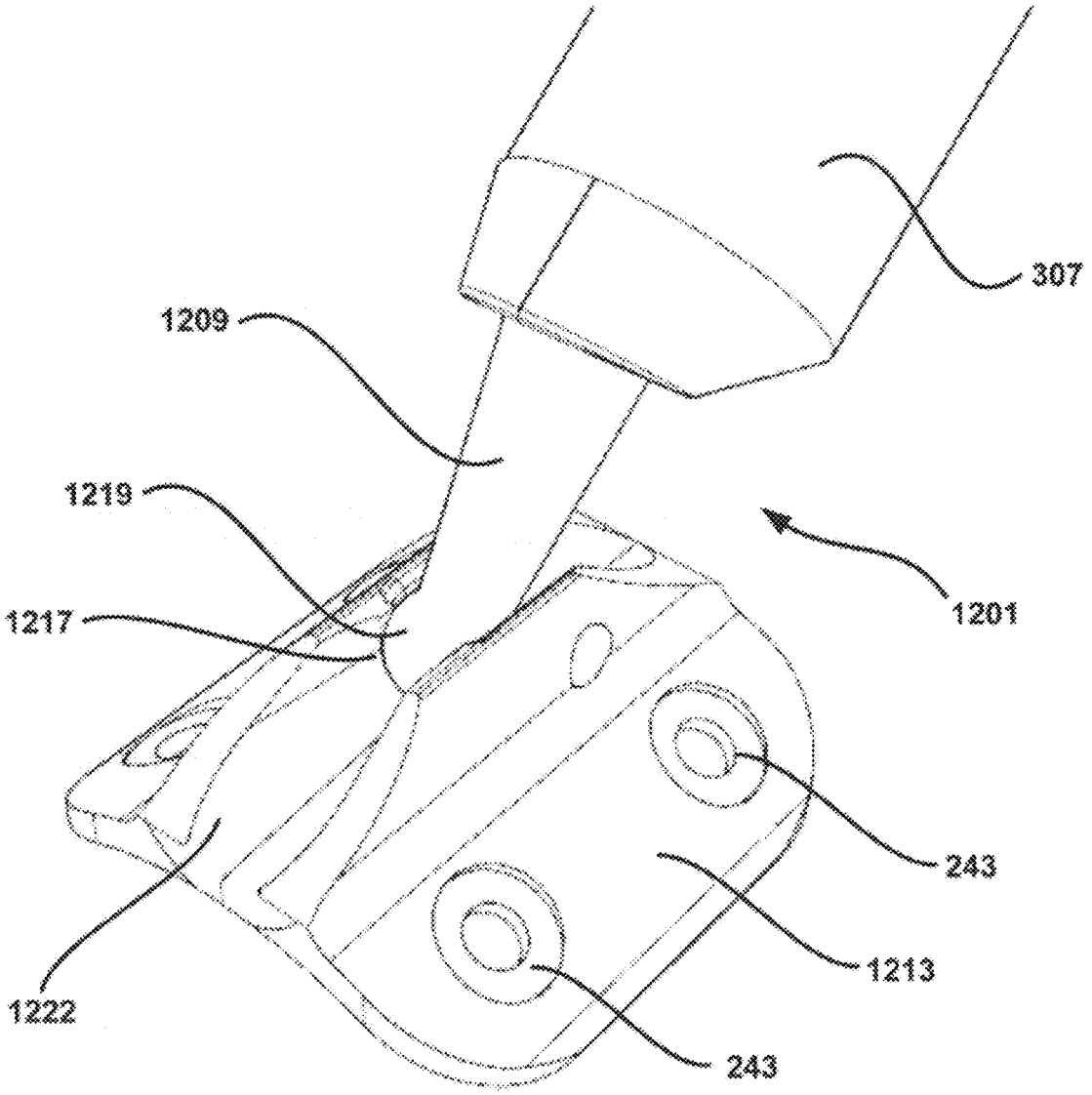
Figure 12F:
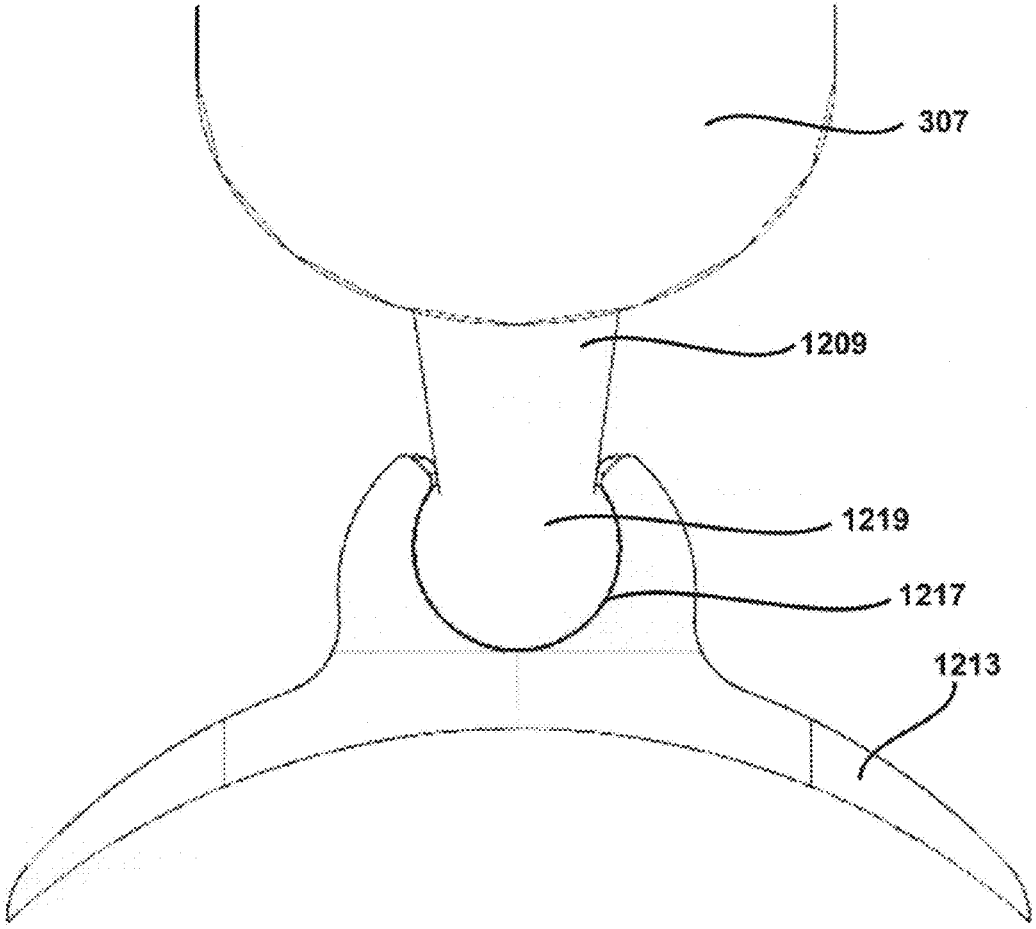
Figure 12G:
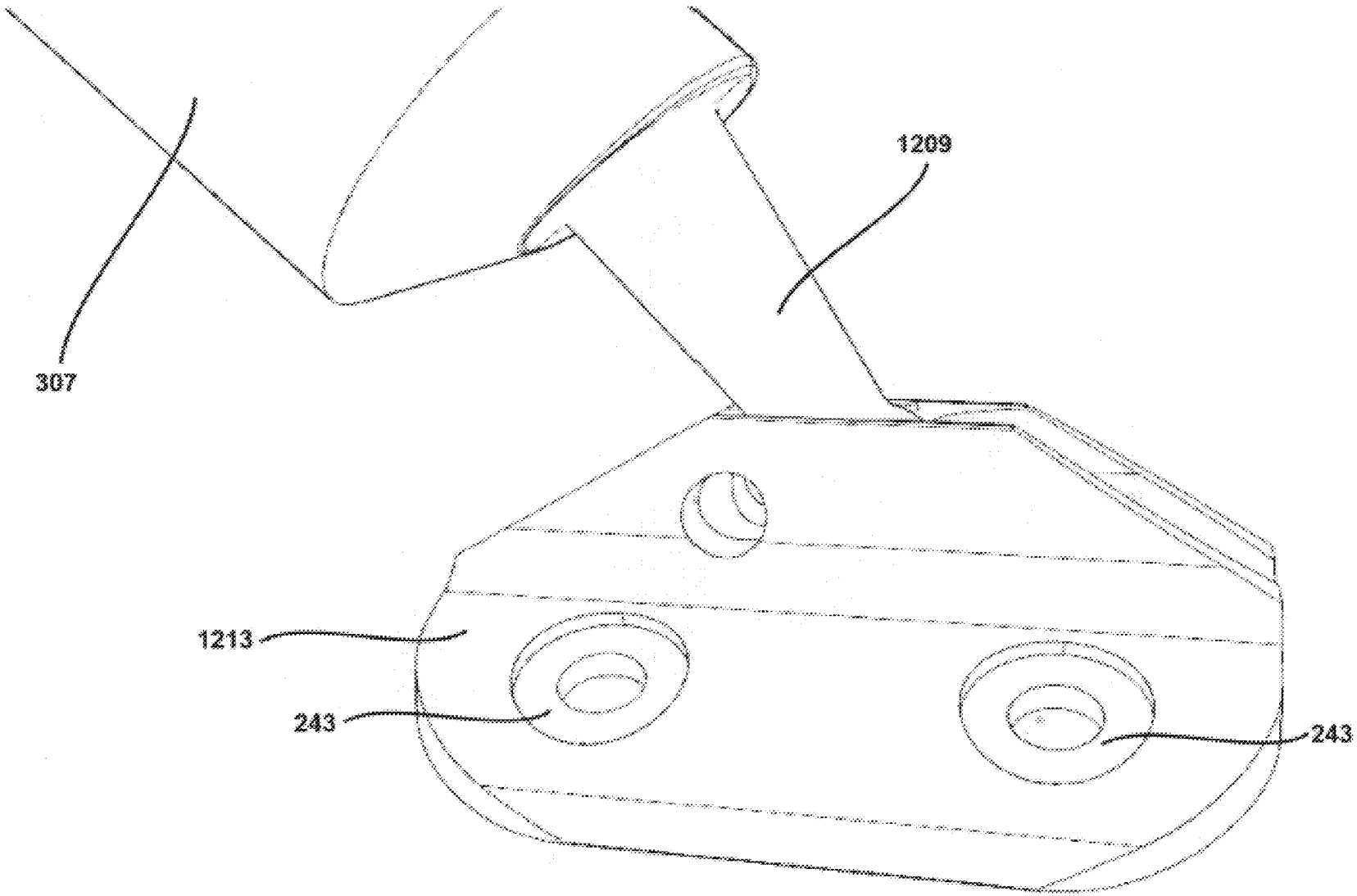

The swivel 1201 will now be described with reference to FIGS. 12(E) to 12(G). The swivel includes a first support 1209 associated with the vang tube 307 and a second support 1213 for mounting to the boom (such as with mounting apertures 243). The first support 1209 includes a ball 1219 for receiving in the socket 1217 of the second support 1213. This may allow relative rotation of the vang tube 307 to the boom. This may include at least partial rotation in two or three axes. The second support 1213 may also include a ball track 1222 to allow the ball 1219 to be selectively inserted and removed from the socket 1217 (similar to the ball joint in the connection 1301).

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A rigging system for a sailboat comprising:

a mast that extends substantially vertical from a hull;

a boom that extends substantially horizontal from the mast;

a substantially arcuate vang tube extending between the mast and the boom to resist relative force and/or moment of the boom towards the mast, wherein a convex side of the arcuate vang tube faces an intersection of the boom and the mast and wherein the arcuate vang tube is located above the boom, and wherein in use, the sail is pushed from a windward side towards the arcuate vang tube, and the arcuate vang tube supports at least part of a sail, and wherein the arcuate vang is configured such that, in use, at least a part of the sail is supported by the arcuate vang tube such that the arcuate vang tube assists a transition from a straight foot of the sail adjacent the boom to a fair curve of the sail.

2. The rigging system according to claim 1 wherein the arcuate vang tube is arcuate with substantially constant radius.

3. The rigging system for a sailboat comprising:

a mast that extends substantially vertical from a hull;

a boom that extends substantially horizontal from the mast; and a substantially arcuate vang tube extending between the mast and the boom to resist relative force and/or moment of the boom towards the mast, wherein a convex side of the arcuate vang tube faces an intersection of the boom and the mast and wherein the vang tube is located above the boom, wherein in use at least a part of the sail is supported by the vang tube such that the vang tube assists a transition from a straight foot of the sail adjacent the boom to a fair curve of the sail, and wherein the sail comprises a luff, and proximal to a tack of the sail, the luff comprises:

a first sheet portion at a windward side of the sail; and a second sheet portion at a leeward side of the sail, wherein in use, the arcuate vang tube passes between the first sheet portion and the second sheet portion such that at least part of the luff is supported by the vang tube.

4. The rigging system according to claim 1 further comprising:

a swivel to couple the vang tube and the boom, the swivel comprising:

a first support associated with the vang tube; and a second support for mounting to the boom, wherein the first support includes a ball for receiving in a socket of the second support to allow relative rotation, at least partially, of the vang tube and the boom.

5. The rigging system according to claim 1 further comprising:

a connection for transferring a first force from the vang tube to the mast of a sailboat, the connection comprising:

a connection base having a key portion to be received in a keyway, wherein the keyway is part of a sail track of the mast;

a mount to receive the vang tube, wherein the first force from the vang tube is transmitted through the mount to the connection base; and a restraint to resists a first component force acting on the connection base, wherein the first component force is a component of the first force transmitted from the vang tube that is in a direction parallel to the keyway.

6. The rigging system according to claim 5 wherein the connection base and the mount are joined with a ball and socket joint, wherein use:

the first force is transmitted from the mount, through the ball and socket joint to the connection base; and wherein the mount is rotatable relative to the connection base to allow relative rotation of the vang tube and the mast.

7. The rigging system according to claim 6 wherein the mount is rotatable relative to the connection base, at least partially, in at least two axes.

8. The rigging system according to claim 6 wherein the mount is rotatable relative to the connection base, at least partially, in at least three axes.

9. The rigging system according to claim 1 further comprising the sail.

10. The rigging system according to claim 1, wherein the arcuate vang tube maintains an area and a depth of the fair curve of the sail aft of the arcuate vang tube.

11. The rigging system according to claim 1, wherein the arcuate vang tube is constructed of extruded aluminium.

12. The rigging system according to claim 1, wherein the arcuate vang tube is constructed of fibre reinforced plastics.

13. The rigging system according to claim 12, wherein the fibre reinforced plastics includes fibre selected from one or more of fibreglass, aramid fibre, carbon fibre.

* * * * *